US011210995B2

(12) United States Patent
Kim et al.

(10) Patent No.: US 11,210,995 B2
(45) Date of Patent: Dec. 28, 2021

(54) DISPLAY MODULE INCLUDING SWEEP ELECTRODE FOR CONTROLLING PWM PIXEL CIRCUIT AND DRIVING METHOD OF DISPLAY MODULE

(71) Applicant: SAMSUNG ELECTRONICS CO., LTD., Suwon-si (KR)

(72) Inventors: Jinho Kim, Suwon-si (KR); Sangmin Shin, Suwon-si (KR); Tetsuya Shigeta, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/790,165

(22) Filed: Feb. 13, 2020

(65) Prior Publication Data

US 2020/0312229 A1 Oct. 1, 2020

(30) Foreign Application Priority Data

Mar. 29, 2019 (KR) ..... 10-2019-0037326

(51) Int. Cl.
*G09G 5/10* (2006.01)
*G09G 3/32* (2016.01)
*G09G 3/20* (2006.01)

(52) U.S. Cl.
CPC ..... *G09G 3/32* (2013.01); *G09G 3/2003* (2013.01); *G09G 3/2081* (2013.01); (Continued)

(58) Field of Classification Search
CPC .... G09G 3/2081; G09G 3/32; G09G 2300/08; G09G 2310/066; G09G 2320/0223; (Continued)

(56) References Cited

U.S. PATENT DOCUMENTS 7,167,169 B2 1/2007 Llbsch et al.
7,808,497 B2 10/2010 Lo et al.
(Continued)

FOREIGN PATENT DOCUMENTS

JP 2000-235370 A 8/2000
JP 4113832 B2 7/2008
(Continued)

OTHER PUBLICATIONS

Written Opinion (PCT/ISA/237) issued by the International Searching Authority in corresponding International Application No. PCT/KR2020/002462, dated Jun. 17, 2020.
(Continued)

*Primary Examiner* — Adam J Snyder
(74) *Attorney, Agent, or Firm* — Sughrue Mion, PLLC

(57) ABSTRACT

Disclosed is a display module. The display module includes a display panel including an inorganic light emitting device, a sweep electrode connected to at least one input pin, and a pulse width modulation (PWM) pixel circuit, and a driving unit configured to provide a sweep signal to the sweep electrode through the at least one input pin, in which the PWM pixel circuit includes a driving transistor, and provides a driving current having a pulse width corresponding to a data voltage to the inorganic light emitting device by changing a voltage of a gate terminal of the driving transistor according to the sweep signal applied through the sweep electrode, and a number of the at least one input pin varies depending on a size of the display panel.

20 Claims, 21 Drawing Sheets

(52) U.S. Cl.
CPC ..... *G09G 2300/0421* (2013.01); *G09G 2300/0439* (2013.01); *G09G 2300/08* (2013.01); *G09G 2310/0243* (2013.01); *G09G 2310/06* (2013.01); *G09G 2310/066* (2013.01); *G09G 2320/0223* (2013.01); *G09G 2320/0233* (2013.01); *G09G 2320/064* (2013.01)

(58) Field of Classification Search
CPC ..... G09G 2320/0233; G09G 2320/064; G09G 2300/0421; G09G 2300/0439; G09G 2310/0243; G09G 2310/06; G09G 3/2003
See application file for complete search history.

(56) References Cited

U.S. PATENT DOCUMENTS

| | | | | |
|---|---|---|---|---|
| 8,269,693 | B2 | 9/2012 | Takagi et al. | |
| 9,671,888 | B2 | 6/2017 | Kim et al. | |
| 2002/0196213 | A1* | 12/2002 | Akimoto | G09G 3/3258 345/82 |
| 2004/0207612 | A1 | 10/2004 | Moon | |
| 2004/0252117 | A1 | 12/2004 | Tanada | |
| 2006/0132053 | A1* | 6/2006 | Cho | G09G 3/3233 315/169.3 |
| 2011/0084993 | A1* | 4/2011 | Kawabe | G09G 3/3233 345/691 |
| 2014/0292622 | A1 | 10/2014 | Lee | |
| 2016/0099262 | A1* | 4/2016 | Lin | G09G 3/32 257/43 |
| 2016/0118971 | A1* | 4/2016 | Sugiyama | G09G 3/32 345/691 |
| 2016/0268239 | A1* | 9/2016 | Shen | H01L 25/0753 |
| 2017/0012026 | A1 | 1/2017 | Choi | |
| 2017/0263183 | A1 | 9/2017 | Lin et al. | |
| 2018/0293929 | A1 | 10/2018 | Shigeta et al. | |
| 2020/0111403 | A1 | 4/2020 | Kim et al. | |

FOREIGN PATENT DOCUMENTS

| | | | |
|---|---|---|---|
| KR | 10-0301664 | B1 | 10/2001 |
| KR | 10-0504790 | B1 | 7/2005 |
| KR | 10-0738233 | B1 | 7/2007 |
| KR | 10-1131265 | B1 | 3/2012 |
| KR | 10-1503823 | B1 | 3/2015 |
| KR | 10-2017-0046233 | A | 5/2017 |
| KR | 10-2020-0009402 | A | 1/2020 |
| KR | 10-2020-0038741 | A | 4/2020 |

OTHER PUBLICATIONS

International Search Report (PCT/ISA/210), issued by International Searching Authority in corresponding International Application No. PCT/KR2020/002462, dated Jun. 17, 2020.
Communication dated Nov. 9, 2021 by the European Patent Office in counterpart European Patent Application No. 201783548.9.

* cited by examiner

DISPLAY MODULE INCLUDING SWEEP ELECTRODE FOR CONTROLLING PWM PIXEL CIRCUIT AND DRIVING METHOD OF DISPLAY MODULE

CROSS-REFERENCE TO RELATED APPLICATIONS

This application claims priority from Korean Patent Application No. 10-2019-0037326, filed in the Korean Intellectual Property Office on Mar. 29, 2019, the disclosure of which is incorporated herein by reference.

BACKGROUND

1. Field

The disclosure relates to a display module and a driving method of a display module, more particularly, relates to a display module in which a light emitting device constitutes pixels, and a driving method of a display module.

2. Description of the Related Art

In the related art, in a display panel in which an inorganic light emitting device such as a red LED, a green LED, or a blue LED constitutes subpixels, gradation of a subpixel has been expressed through a pulse amplitude modulation (PAM) driving system from active matrix driving systems.

The PAM driving system is a system of driving an inorganic light demitting device using a pixel circuit consisting of a transistor and/or a capacitor, and the PAM driving system is a system of expressing gradation through an amplitude (or magnitude) of a driving current.

However, in a case of the PAM driving system, not only the gradation of light emitted by the organic light emitting device, but also a wavelength is changed in accordance with the amplitude of the driving current, thereby deteriorating color reproducibility of an image. FIG. 1 shows changes in wavelengths according to a magnitude (or amplitude) of a driving current flowing through a blue LED, a green LED and a red LED.

Accordingly, for the driving of a display panel in which the inorganic light emitting device directly constitutes subpixels, it is necessary to execute pulse width modulation (PWM) driving of expressing gradation with a pulse width of a driving current.

The PWM driving system includes a digital PWM driving system and an analog PWM driving system. However, in a case of the digital PWM driving system, the gradation is expressed in a subfield system, thereby incurring a problem regarding false contouring noise, and in a case where the number of subfields is increased to reduce the false contouring problem, a light emitting duty ratio may decrease.

Accordingly, the analog PWM driving is suitable for the driving of the display panel in which the inorganic light emitting device constitutes subpixels. The analog PWM system is a system of vertically shifting a data voltage set (or programmed) in a gate terminal of a driving transistor through an external sweep signal (for example, triangle wave) to control turning on or off of the driving transistor, thereby controlling duration of the driving current (that is, light emitting duration of the light emitting device).

In such an analog PWM driving system, it is important to uniformly apply a sweep signal in a predetermined region of a display panel. This is because, in a case where the sweep signal is not uniformly applied, a difference in luminance occurs in accordance with the sweep signal although the data voltage is uniform. In a case of a display panel of the related art, the sweep signal has not been uniformly applied to a driving transistor due to a deviation in RC load in a sweep electrode, and accordingly, a problem regarding a deviation in luminance has occurred even with the same data voltage.

SUMMARY

The disclosure has been made in accordance with the above-described problems, and an object of the disclosure is to provide a display module having a sweep electrode structure capable of uniformly providing a sweep signal, and a driving method of a display module.

According to an embodiment of the disclosure, a display module includes a display panel including an inorganic light emitting device, a sweep electrode connected to at least one input pin, and a pulse width modulation (PWM) pixel circuit, and a driving unit configured to provide a sweep signal to the sweep electrode through the at least one input pin in which the PWM pixel circuit includes a driving transistor, and provides a driving current having a pulse width corresponding to a data voltage to the inorganic light emitting device by changing a voltage of a gate terminal of the driving transistor according to the sweep signal applied through the sweep electrode, and a number of the at least one input pin varies depending on a size of the display panel.

Based on the display panel having a first size, a first number of input pins may be provided as the at least one input pin in the display panel, and based on the display panel having a second size greater than the first size, a second number of the input pins which is more than the first number may be provided in the display panel.

Based on the at least one input pin connected to the sweep electrode being a plurality of input pins, the driving unit may provide the same sweep signal through each of the plurality of input pins spaced apart at regular intervals.

The display panel may have a stacked structure including first to fourth metal layers, the first metal layer may include a gate terminal of the driving transistor, the second metal layer may include source and drain terminals of the driving transistor, the third metal layer may include an electrode for supplying a driving voltage to the PWM pixel circuit, and the fourth metal layer may include an electrode for connecting the PWM pixel circuit and the inorganic light emitting device to each other.

The sweep electrode may include a plurality of first metal lines disposed on the first metal layer, and a plurality of second metal lines which are disposed on the second metal layer and connect the plurality of first metal lines to each other, and the gate terminal of the driving transistor may be connected to a metal line among the plurality of first metal lines.

The at least one input pin may be connected to at least one metal line provided in an edge region among the plurality of first metal lines and the plurality of second metal lines.

The sweep electrode may further include a shorting bar disposed on at least one of the third metal layer and the fourth metal layer, and connected to at least one metal line of the plurality of first metal lines through at least one via hole.

The shorting bar may be provided in an edge region of at least one metal layer of the third metal layer and the fourth metal layer, and may be connected to a metal line provided in the edge region among the plurality of first metal lines through the via hole, and the at least one input pin may be connected to the shorting bar provided in the edge region.

The shorting bar may have a size greater than each of the plurality of first metal lines.

The sweep electrode may be provided in a plurality of block units, a plurality of input pins may be provided, the plurality of input pins may be connected to each of the plurality of sweep electrode blocks symmetrically to each other, and the driving unit may provide the sweep signal at different time in the sweep electrode block units through the plurality of input pins connected to each block.

According to another embodiment of the disclosure, a driving method of a display module including a display panel including an inorganic light emitting device, a sweep electrode connected to at least one input pin, and a pulse width modulation (PWM) pixel circuit includes setting a data voltage to a gate terminal of a driving transistor included in the PWM pixel circuit, providing a sweep signal to the sweep electrode through the at least one input pin, and based the sweep signal applied to the PWM pixel circuit through the sweep electrode, providing a driving current having a pulse width corresponding to the set data voltage to the inorganic light emitting device by changing a voltage of a gate terminal of the driving transistor according to the sweep signal, and a number of at least one input pin varies depending on a size of the display panel.

Based on the display panel having a first size, a first number of input pins may be provided as the at least one input pin in the display panel, and based on the display panel having a second size greater than the first size, a second number of the input pins which is more than the first number may be provided in the display panel.

The providing a sweep signal may include, based on the at least one input pin connected to the sweep electrode being a plurality of input pins, providing the same sweep signal through each of the plurality of input pins spaced apart at regular intervals.

The display panel may have a stacked structure including first to fourth metal layers, the first metal layer may include a gate terminal of the driving transistor, the second metal layer may include source and drain terminals of the driving transistor, the third metal layer may include an electrode for supplying a driving voltage to the PWM pixel circuit, and the fourth metal layer may include an electrode for connecting the PWM pixel circuit and the inorganic light emitting device to each other.

The sweep electrode may include a plurality of first metal lines disposed on the first metal layer, and a plurality of second metal lines which are disposed on the second metal layer and connect the plurality of first metal lines to each other, the gate terminal of the driving transistor may be connected to a metal line among the plurality of first metal lines.

The at least one input pin may be connected to at least one metal line provided in an edge region among the plurality of first metal lines and the plurality of second metal lines.

The sweep electrode may further include a shorting bar disposed on at least one of the third metal layer and the fourth metal layer, and connected to at least one metal line of the plurality of first metal lines through at least one via hole.

The shorting bar may be provided in an edge region of at least one metal layer of the third metal layer and the fourth metal layer, and may be connected to a metal line provided in the edge region among the plurality of first metal lines through the via hole, and the at least one input pin may be connected to the shorting bar provided in the edge region.

The shorting bar may have a size greater than each of the plurality of first metal lines.

The sweep electrode may be provided in a plurality of block units, a plurality of input pins may be provided, the plurality of input pins may be connected to each of the plurality of sweep electrode blocks symmetrically to each other, and the providing a sweep signal may include providing the sweep signal at different time in the sweep electrode block units through the plurality of input pins connected to each block.

As described above, according to various embodiments of the disclosure, a sweep electrode structure capable of uniformly providing a sweep signal may be provided. Therefore, a problem regarding a deviation in luminance due to a deviation in RC load in a sweep electrode in a display module may be solved.

DETAILED DESCRIPTION

In describing the disclosure, a detailed description of the related art is omitted when it is determined that the detailed description may unnecessarily obscure a gist of the disclosure. In addition, the overlapping description of the same configuration may be omitted.

The suffix "part" for an element used in the following description is given or used in consideration of the ease of writing the specification, and does not have a distinct meaning or role as it is.

The terms used in the disclosure are used to describe an embodiment, but may not intend to limit the scope of other embodiments. Unless otherwise defined specifically, a singular expression may encompass a plural expression.

It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

The terms "first," "second," or the like used in the disclosure may denote various elements, regardless of order and/or importance, and may be used to distinguish one element from another, and does not limit the elements.

If it is described that a certain element (e.g., first element) is "operatively or communicatively coupled with/to" or is "connected to" another element (e.g., second element), it should be understood that the certain element may be connected to the other element directly or through still another element (e.g., third element). On the other hand, if it is described that a certain element (e.g., first element) is "directly coupled to" or "directly connected to" another element (e.g., second element), it may be understood that there is no element (e.g., third element) between the certain element and the another element.

Unless otherwise defined, the terms used in embodiments of the disclosure may be understood in its usual acceptation in the corresponding technical field by a person skilled in the art.

Hereinafter, various embodiments of the disclosure will be described in detail with reference to the accompanying drawings.

Figure 1:
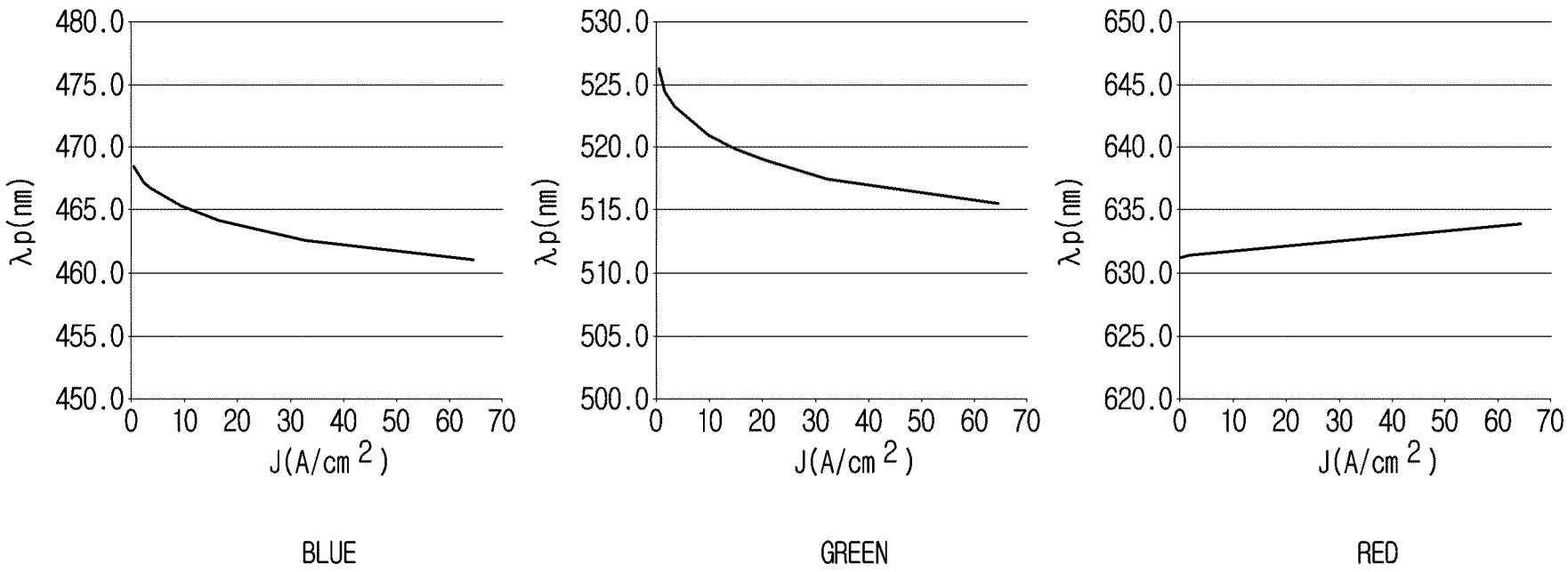
FIG. 1 is a graph showing a change of wavelengths in accordance with a magnitude of a driving current flowing through a blue LED, a green LED, and a red LED.
Figure 2A:
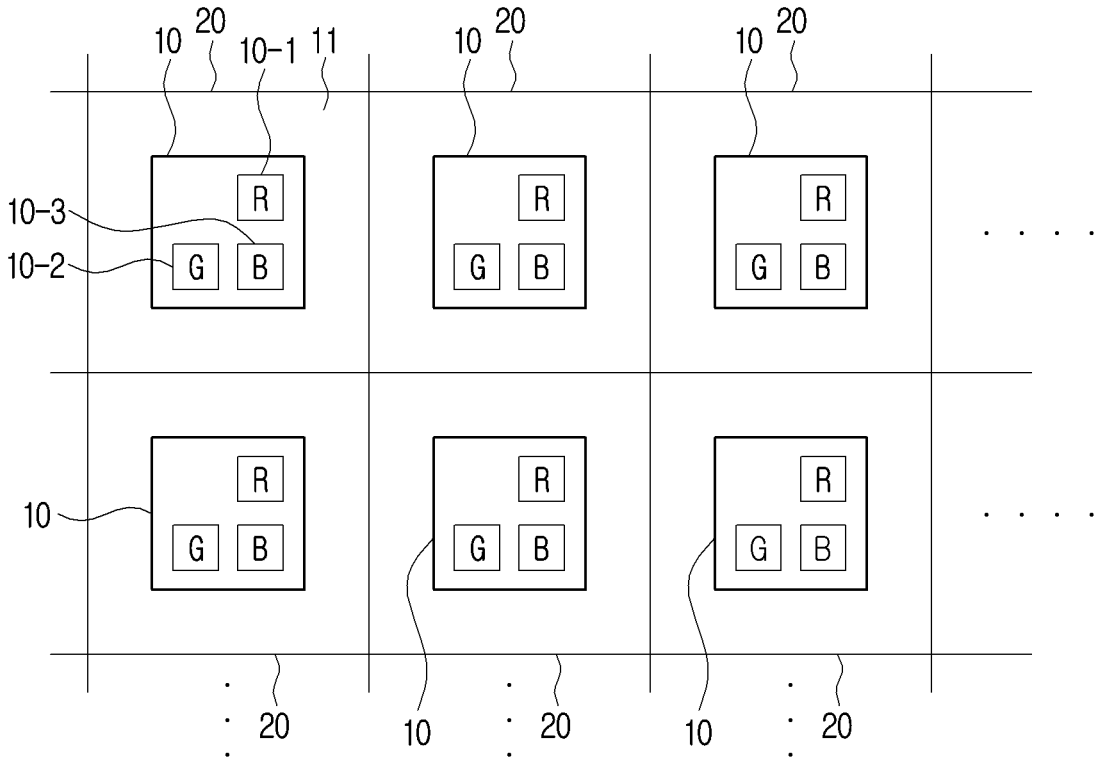
FIG. 2A is a view for describing a pixel structure of a display panel according to an embodiment.

FIG. 2A is a view for describing a pixel structure of a display panel 100 according to an embodiment of the disclosure. As shown in FIG. 2A, the display panel 100 may include a plurality of pixels 10 arranged in a matrix form.

Each pixel 10 may include a plurality of subpixels 10-1 to 10-3. For example, one pixel 10 included in the display panel 100 may include three types of subpixels such as a red (R) subpixel 10-1, a green (G) subpixel 10-2, and a blue (B) subpixel 10-3. That is, a set of the R, G, and B subpixels may constitute one unit pixel of the display panel 100.

Referring to FIG. 2A, a pixel region 20 in the display panel 100 may include a region 10 occupied by a pixel and a peripheral region 11.

The region 10 occupied by a pixel may include R, G, and B subpixels 10-1 to 10-3, as shown in the drawing. Specifically, the R subpixel 10-1 may include an R light emitting element and a pixel circuit for driving the R light emitting element, the G subpixel 10-2 may include a G light emitting element and a pixel circuit for driving the G light emitting element, and the B subpixel 10-3 may include a B light emitting element and a pixel circuit for driving the B light emitting element, respectively. The pixel circuit may include a PWM pixel circuit for executing PWM driving of a connected inorganic light emitting element, but there is no limitation thereto.

The peripheral region 11 of the pixel 10 may include various circuits for driving pixel circuits variously in accordance with an embodiment. In addition, the display panel 100 may include a sweep electrode for applying a sweep signal to the PWM pixel circuit. This will be described later in detail.

Figure 2B:
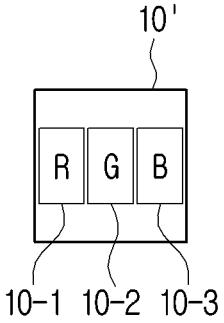
FIG. 2B is a view showing a subpixel structure according to another embodiment.

FIG. 2B is a view showing a subpixel structure according to another embodiment of the disclosure. Referring to FIG. 2A, the subpixels 10-1 to 10-3 are arranged in one pixel 10 in a shape of horizontally-flipped L. However, the embodiment is not limited thereto, and the R, G, and B subpixels 10-1 to 10-3 may be arranged in a line in a pixel 10', as shown in FIG. 2B. Such an arrangement of the subpixels is merely an example, and a plurality of subpixels may be arranged in various forms in each pixel according to an embodiment.

In the example described above, it is described that the pixel is configured with three types of subpixels, but there is no limitation thereto. For example, the pixel may be implemented with four types of subpixels of R, G, B, and W (white), and any number of subpixels may constitute one pixel according to an embodiment. Hereinafter, for convenience of description, a case of the pixel 10 configured with three types of subpixels of R, G, and B will be described as an example.

Figure 3:
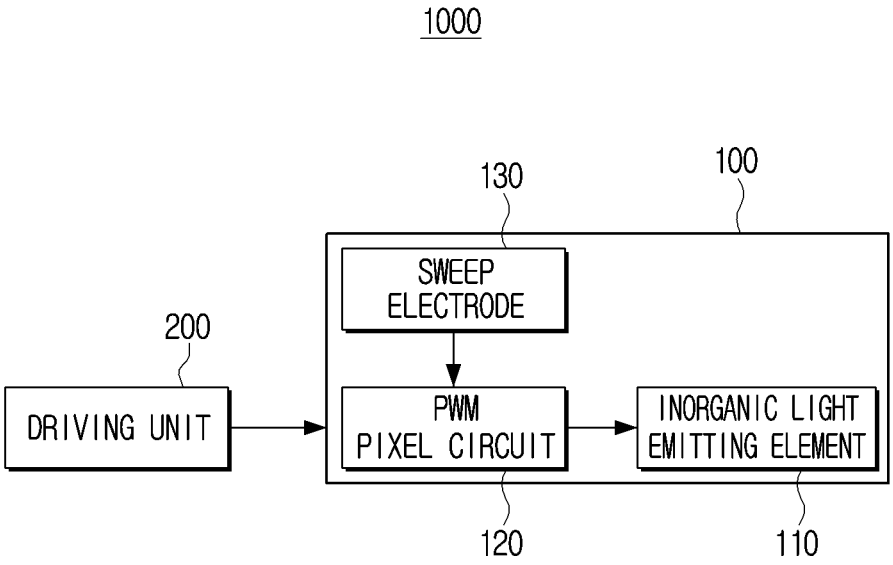
FIG. 3 is a block diagram of a display module according to an embodiment.

FIG. 3 is a block diagram of a display module 1000 according to an embodiment of the disclosure. Referring to FIG. 3, the display module 1000 includes the display panel 100 and a driving unit 200.

The display panel 100 may include an inorganic light emitting element 110, a PWM pixel circuit 120, and a sweep electrode 130. As will be described later, the display panel 100 may have a structure in which the PWM pixel circuit 120 is formed on a substrate 30 and the inorganic light emitting element 110 is disposed on the PWM pixel circuit 120. FIG. 3 shows only a configuration regarding one subpixel included in the display panel 100 for convenience of description.

The inorganic light emitting element 110 may constitute subpixels 10-1 to 10-3 of the display panel 100 and a plurality of types thereof may be provided in accordance with colors of light emitted. For example, the inorganic light emitting element 110 may be provided as a red (R) inorganic light emitting element configured to emit red light, a green (G) inorganic light emitting element configured to emit green light, and a blue (B) inorganic light emitting element configured to emit blue light.

Accordingly, the type of subpixel may be determined in accordance with the type of the inorganic light emitting element 110. That is, an R inorganic light emitting element may constitute the R subpixel 10-1, a G inorganic light emitting element may constitute the g subpixel 10-2, and a B inorganic light emitting element may constitute the B subpixel 10-3.

The inorganic light emitting element 110 is a light emitting element manufactured by using an inorganic material which is different from an organic light emitting diode (OLED) manufactured by using an organic material.

According to an embodiment of the disclosure, the inorganic light emitting element 110 may be a micro-light emitting diode (LED) (μ-LED). The micro LED is a micro-inorganic light emitting element having a size of 100 micrometers (μm) or less which emits light itself without a backlight or a color filter.

The inorganic light emitting element 110 may emit light with different luminance in accordance with an amplitude or a pulse width of a driving current provided. The pulse width of the driving current herein may be expressed as a duty ratio of the driving current or duration of the driving current. For example, the inorganic light emitting element 110 may emit light with higher luminance as the amplitude of the driving current is great, and may emit light with higher luminance as the pulse width is long (that is, as the duty ratio is high or the duration is long), but there is no limitation thereto.

In particular, according to an embodiment of the disclosure, the inorganic light emitting element 110 may emit light based on a driving current having a pulse width controlled by the PWM pixel circuit 120. That is, the inorganic light emitting element 110 may be driven by PWM.

The PWM pixel circuit 120 may execute PWM driving of the inorganic light emitting element 110. A PWM driving system is a system of expressing gradation according to light emitting time of the inorganic light emitting element 110. Accordingly, in a case of driving the inorganic light emitting element 110 in the PWM system, various gradations may be expressed by changing a pulse width, although the amplitude is the same. Accordingly, a problem regarding a change in a wavelength of light emitted by an LED (particularly, micro-LED) in accordance with gradation due to the driving of the LED only in a PAM system may be solved.

The PWM pixel circuit 120 may control a pulse width of a driving current provided by a current source (not shown) based on a PWM data voltage applied. The current source may be configured to include a PAM pixel circuit (150 in FIG. 5) according to an embodiment.

In particular, the PWM pixel circuit 120 may include a driving transistor (not shown), and control a voltage of a gate terminal of the driving transistor according to various signals (or voltages) applied to control the pulse width of the driving current.

Specifically, when a PWM data voltage corresponding to certain gradation is applied, the PWM pixel circuit 120 may set (or program) the applied PWM data voltage in the gate terminal of the driving transistor.

After that, when a sweep signal is applied through the sweep electrode 130, the PWM pixel circuit 120 changes the voltage of the gate terminal of the driving transistor according to the sweep signal, and accordingly, a driving current having a pulse width corresponding to the set PWM data voltage may be provided to the inorganic light emitting element 100.

The sweep signal herein may be a signal linearly changing such as a triangle wave, by a voltage applied from the outside for a linear change of the voltage of the gate terminal of the driving transistor, but it is not limited thereto.

According to an embodiment of the disclosure, the sweep electrode 130 may be connected to at least one input pin (not shown), and the sweep signal may be input from the outside of the display panel 100 through the input pin. Accordingly, the sweep signal may be applied to each of the plurality of PWM pixel circuit 120 included in the display panel 100 through the sweep electrode 130. According to an embodiment of the disclosure, the input pin may be formed on a TFT layer 40 which will be described later as a conductive pad (or electrode pad). The number of input pins may vary depending on a size of the display panel 100, and this will be described later in detail.

As described above, the subpixels are configured in units of the inorganic light emitting element 110 and accordingly, the display panel 100 may express gradation in subpixel unit by driving the PWM pixel circuit 120, unlike a liquid crystal display (LCD) panel using a plurality of LEDs emitting the same single color as a backlight.

For this, each subpixel included in the display panel 100 may include the inorganic light emitting element 110, and the PWM pixel circuit 120 for driving the inorganic light emitting element 110. That is, the PWM pixel circuit 120 for driving the inorganic light emitting element 110 may exist for each subpixel.

According to an embodiment, the display panel 100 may further include a MUX circuit for selecting any one of the plurality of subpixels 10-1 to 10-3 constituting the pixel 10, an electrostatic discharge (ESD) protection circuit for preventing static generated in the display panel 100, a power circuit for supplying a power to the pixel circuits 120 and 150, and a clock providing circuit for providing a clock for driving the pixel circuits 120 and 150.

The driving unit 200 drives the display panel 100. Specifically, the driving unit 130 may drive the display panel 100 by providing various control signals and data signals to the display panel 100.

Particularly, the driving unit 200 may provide the sweep signal to the sweep electrode 130 through the input pin. Accordingly, the driving unit 200 may include a sweep signal providing circuit (not shown).

In addition, the driving unit 200 may further include at least one gate driver for driving pixels of the display panel 100 disposed in a matrix form in a vertical line unit, a data driver (or source driver) for providing a data voltage (for example, PAM data voltage or PWM data voltage) to each pixel or each subpixel, and the like.

The driving unit 200 may be separately provided outside of the display panel 100 and may be connected to the display panel 100 through a separate wiring. Alternatively, the driving unit 200 may be implemented together with the pixel circuits 120 and 150 in the display panel 100.

However, the embodiment is not limited thereto, and some configurations of various drivers and circuits included in the driving unit 200 may be implemented in the display panel 100 and the other configurations may be separately provided outside of the display panel 100. For example, the sweep signal providing circuit may be configured to be mounted in an external printed circuit board (PCB) together with a processor or a timing controller (TCON), and the gate driver may be configured to be included in a TFT layer of the display panel 100.

Meanwhile, the display module 1000 according to various embodiments of the disclosure may be installed as a single unit in wearable devices, portable devices, handheld devices, and various electronic products or vehicle requiring a display. In addition, a plurality of display modules 1000 may be assembled and applied to a display apparatus such as a monitor for a personal computer (PC), a high-resolution TV, signage, an electronic display, and the like.

Figure 4:
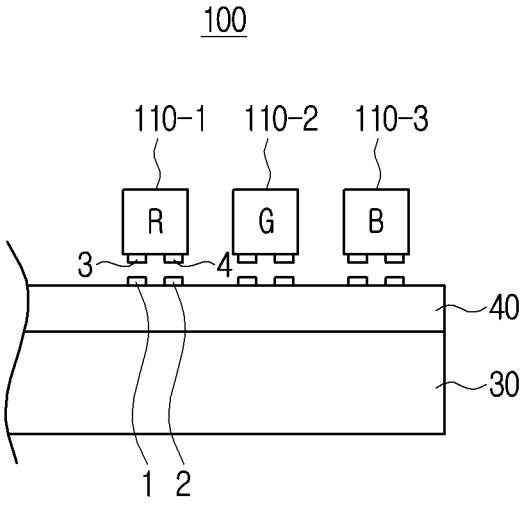
FIG. 4 is a cross-sectional view of a display panel according to an embodiment.

FIG. 4 is a cross-sectional view of the display panel 100 according to an embodiment of the disclosure. FIG. 4 shows only one pixel included in the display panel 100, for convenience of description.

Referring to FIG. 4, the display panel 100 includes the substrate 30, a TFT layer 40, and inorganic light emitting elements R, G, and B 110-1 to 110-3. The PWM pixel circuit 120 or the PAM pixel circuit 150 may be implemented as a thin film transistor (TFT) and included in the TFT layer 40 formed on the substrate 30. Each of the inorganic light emitting elements R, G, and B 110-1 to 110-3 is disposed on the TFT layer 40 and constitutes each of the subpixels 10-1 to 10-3 of the display panel 100. The substrate 30 may have a material such as glass or a synthetic resin.

Meanwhile, although not clearly shown in the drawing, the PWM pixel circuit 120 and/or the PAM pixel circuit 150 for driving the inorganic light emitting elements 110-1 to 110-3 may exist in the TFT layer 40 for each of the inorganic light emitting elements 110-1 to 110-3. Each of the inorganic light emitting elements R, G, and B 110-1 to 110-3 may be mounted or disposed on the TFT layer 40 so as to be electrically connected to the corresponding pixel circuits 120 and 150.

For example, as shown in FIG. 4, the R inorganic light emitting element 110-1 may be mounted or disposed so that an anode electrode 3 and a cathode electrode 4 of the R inorganic light emitting element 110-1 are respectively connected to an anode electrode 1 and a cathode electrode 2 formed on the pixel circuits 120 and 150 (not shown) for driving the R inorganic light emitting element 110-1, and the same applies to the G inorganic light emitting element 110-2 and the B inorganic light emitting element 110-3. According to an embodiment, at least one of the anode electrode 1 and the cathode electrode 2 may be implemented as a common electrode.

FIG. 4 shows an example in which each of the inorganic light emitting elements 110-1 to 110-3 is a flip chip micro-LED. However, there is no limitation thereto, and each of the inorganic light emitting elements 110-1 to 110-3 may be a lateral or vertical micro-LED according to an embodiment.

The TFT layer 40 includes the pixel circuits 120 and 150 implemented as a TFT and is formed on one surface of the substrate 30. According to an embodiment of the disclosure, at least some of various circuits for driving the pixel circuits 120 and 150 described above (for example, a MUX circuit, an ESD protection circuit, a power circuit, a clock providing circuit, and the like), and various drivers and circuits included in the driving unit 130 (for example, a sweep signal providing circuit, a gate driver, a data driver, and the like) may be formed on the TFT layer 40 together with the pixel circuits 120 and 150.

In addition, according to an embodiment, at least some of the various circuits described above (for example, a MUX circuit, an ESD protection circuit, a power circuit, a clock providing circuit, and the like) and the various drivers and circuits included in the driving unit 130 (for example, a sweep signal providing circuit, a gate driver, a data driver, and the like) may be separately provided on the other surface of the substrate 30 or may be provided as separate chips and may be connected to the pixel circuits 120 and 150 of the TFT layer 40 through internal wirings.

One end of the internal wiring may be connected to the conductive pad (or electrode pad) provided on the TFT layer 40, and the other end thereof may be connected to the at least some of the various circuits described above (for example, a MUX circuit, an ESD protection circuit, a power circuit, a clock providing circuit, and the like) and the various drivers and circuits included in the driving unit 130 (for example, a sweep signal providing circuit, a gate driver, a data driver, and the like).

In this case, for example, the sweep signal provided from the sweep signal providing circuit may be applied to the sweep electrode through the internal wiring and the conductive pad (or electrode pad) and provided to the PWM pixel circuit 120. Accordingly, in this case, the conductive pad (or electrode pad), to which the sweep signal is applied via the internal wiring, may be the sweep signal input pin according to the embodiments of the disclosure.

Figure 5:
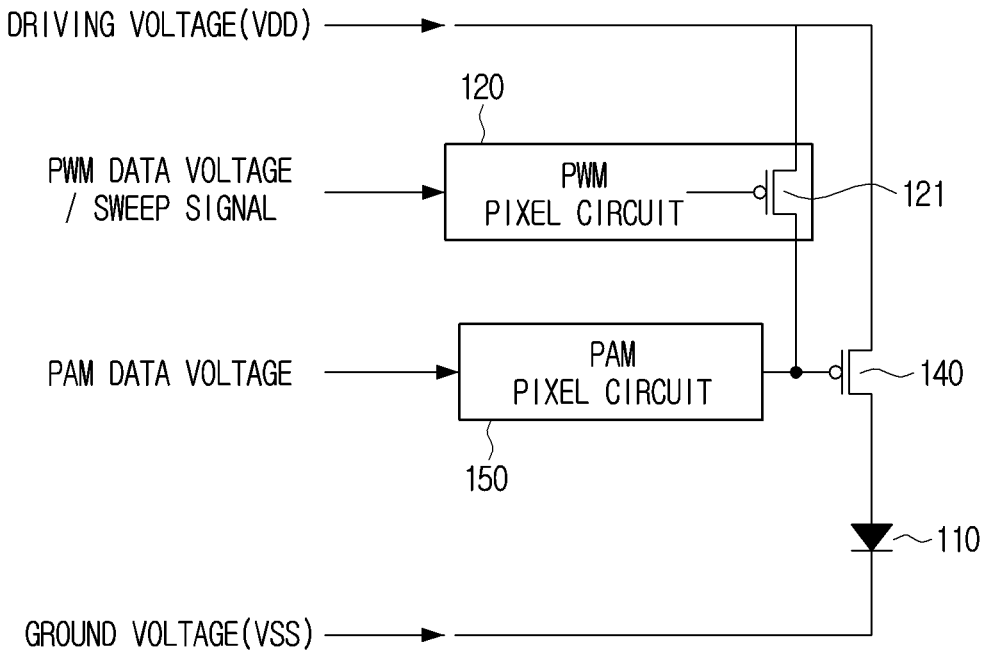
FIG. 5 is a view for describing an operation of a PWM pixel circuit according to an embodiment.

FIG. 5 is a view for describing an operation of the PWM pixel circuit according to an embodiment of the disclosure. FIG. 5 shows only one inorganic light emitting element 110 and one of each of the pixel circuits 120 and 150 for driving the inorganic light emitting element 110 for convenience of description.

The PAM pixel circuit 150 may control an amplitude of a driving current provided to the inorganic light emitting element 110 based on an applied PAM data voltage, and the PWM pixel circuit 120 may control a pulse width of the driving current provided to the inorganic light emitting element 110 based on an applied PWM data voltage.

Specifically, the PAM pixel circuit 150 provides a driving current having an amplitude corresponding to a PAM data voltage to the inorganic light emitting element 110. At this time, the PWM pixel circuit 12 controls a holding time of the driving current (that is, driving current having an amplitude corresponding to the PAM data voltage) provided to the inorganic light emitting element 110 by the PAM pixel circuit 150 based on the PWM data voltage, thereby controlling a pulse width of the driving current.

Meanwhile, regarding all of the subpixels, the same PAM data voltage may be applied to the PAM pixel circuit 150, and in this case, the PAM pixel circuit 150 may play a role of a constant current source together with a transistor 140. That is, the PAM pixel circuit 150 of all subpixels provides a driving current having the same amplitude to the inorganic light emitting element 110.

According to an embodiment of the disclosure, the PAM pixel circuit 150 may provide a driving current having the same amplitude to the inorganic light emitting element 110, except for a particular case of requiring a high dynamic range (HDR) driving. Accordingly, gradation of an image may be expressed through the PWM pixel circuit 120.

The inorganic light emitting element 110 may emit light with different luminance in accordance with a pulse width of a driving current provided by the PWM pixel circuit 120. The pulse width of the driving current may be referred to as a duty ratio of the driving current or duration of the driving current.

Specifically, referring to FIG. 5, when a driving voltage (VDD) is applied to the inorganic light emitting element 110, in a state where the PAM data voltage is input and set to the PAM pixel circuit 150 and the PWM data voltage is input and set to a gate terminal of a driving transistor 121 of the PWM pixel circuit 120, the PAM pixel circuit 150 provides a driving current having an amplitude corresponding to the PAM data voltage to the inorganic light emitting element 110, and the inorganic light emitting element 110 starts light emission.

At this time, a sweep signal (for example, a linearly changing voltage) is started to be applied to the PWM pixel circuit 120. When the sweep signal is applied, the voltage of the gate terminal of the driving transistor 121 changes in accordance to the sweep signal from the voltage based on the PWM data voltage. Meanwhile, the driving transistor 121 in an off state maintains the off state until the voltage of the gate terminal changes in accordance with the sweep signal and reaches a threshold value of the driving transistor 121.

When the voltage of the gate terminal of the driving transistor 121 reaches a threshold voltage of the driving transistor 121, the driving transistor 121 is turned on, and accordingly, the driving voltage (VDD) applied to a source terminal of the driving transistor 121 is applied to a gate terminal of the transistor 140 through a drain terminal of the driving transistor 121.

The driving voltage (VDD) is applied to a source terminal of the transistor 140, and accordingly, when the driving voltage (VDD) is applied to the gate terminal of the transistor 140, a voltage between the gate terminal and the source terminal of the transistor 140 exceeds a threshold voltage of the transistor 140, thereby turning off the transistor 140 (for reference, a PMOSFET has a negative value of a threshold value, and thus, it is turned on, when a voltage equal to or less than the threshold voltage is applied between a gate terminal and a source terminal, and turned off, when a voltage exceeding the threshold voltage is applied). When the transistor 140 is turned off, no more driving current flows, and the inorganic light emitting element 110 stops light emission.

At this time, the same sweep signal is applied to all of the PWM pixel circuits 120, and accordingly, assuming that the threshold voltages of the driving transistors 121 are the same as each other (in practice, a difference in threshold voltage may exist between the driving transistors 121 but may be compensated), theoretically, the pulse width of the driving current only depends on the PWM data voltage. As described above, the PWM pixel circuit 120 may provide the driving current having a pulse width corresponding to the PWM data voltage to the inorganic light emitting element 110 by controlling the voltage of the gate terminal of the driving transistor 121.

Figure 6:
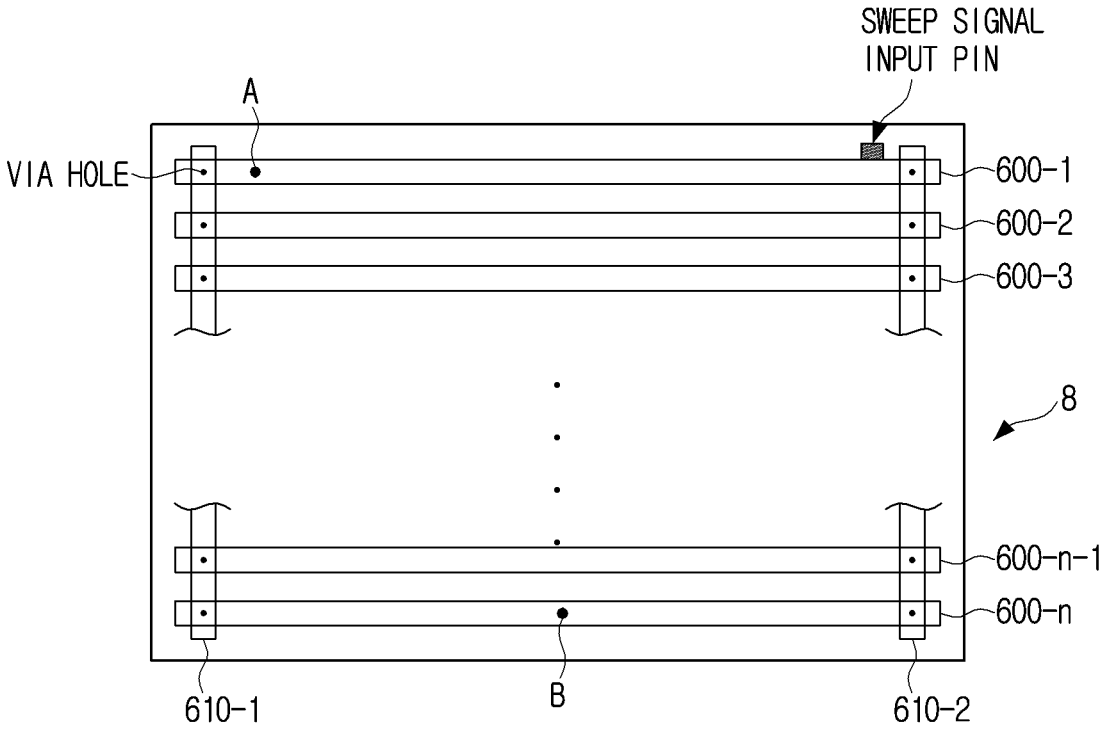
FIG. 6 is a view for describing a problem due to a deviation in RC load in a sweep electrode in the related art.
Figure 6:
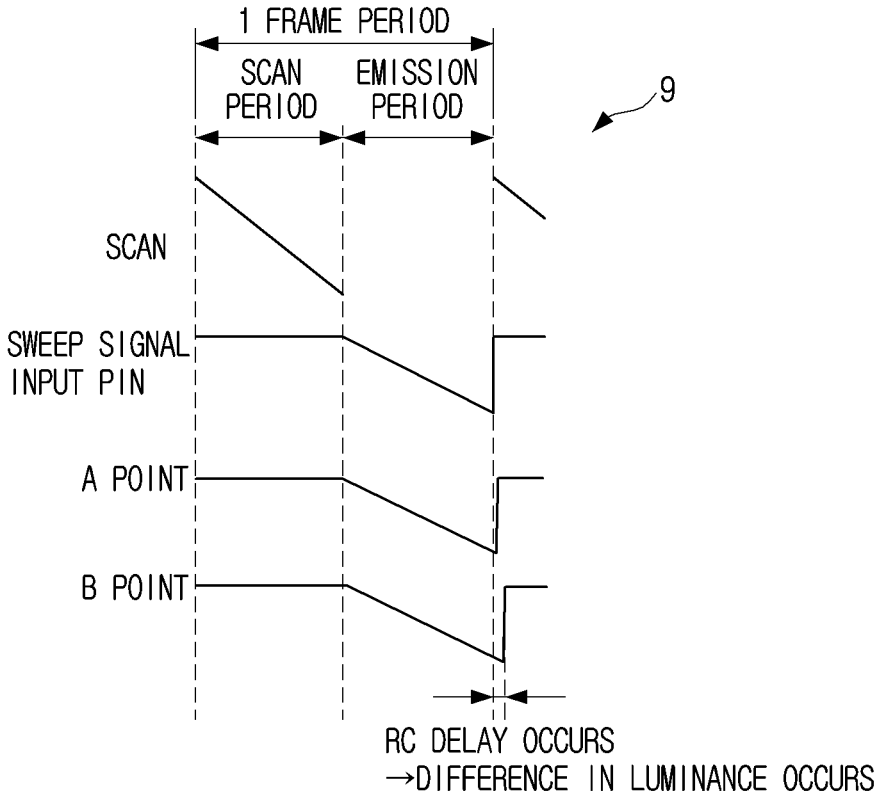

FIG. 6 is a view for describing a problem due to a deviation in RC load in a sweep electrode in the related art. As described above, in order for the PWM pixel circuit 120 to express accurate gradation according to the PWM data voltage, it is important to uniformly apply the sweep signal to the display panel 100. But, a difference may occur in actual sweep signal for each region due to a deviation in RC load for each region of the sweep electrode.

A reference numeral 8 in FIG. 6 denotes a sweep electrode of a display panel of the related art. Specifically, the sweep electrode of the related art has a structure in which horizontal metal lines 600-1 to **600-*n* and vertical metal lines 610-1 and 610-2** are connected to each other through via holes in the display panel. In addition, the drawing shows that one sweep signal input pin is connected to the sweep electrode.

Although not shown in the drawing, PWM pixel circuits respectively corresponding to subpixels may be connected to the sweep electrode at a position of each subpixel in the display panel and may receive a sweep signal through the sweep electrode. Accordingly, the sweep signal is input through the sweep signal input pin and provided to all PWM pixel circuits included in the display panel through the sweep electrode.

As described above, when the sweep signal is transmitted to the PWM pixel circuit through the sweep electrode, an RC delay occurs due to a resistance component and a parasitic capacitance component of the sweep electrode.

Specifically, a reference numeral 9 in FIG. 6 shows that, in a case of the display panel of the related art, a difference in sweep signal occurs between the sweep signal input pin and an A point and a B point. Particularly, a significant delay may be observed at the B point which is farther from the sweep signal input pin and this is because a resistance component to the B point is greater than a resistance component to the A point with respect to the sweep signal input pin.

Such a difference in sweep signal for each region of the display panel is a problem because it causes a difference in luminance of the light emitting element with respect to the same PWM data voltage. Particularly, as the size of the display panel increases, a deviation in RC load for each sweep electrode in the panel further increases. Accordingly, as in the related art, a structure of applying a sweep signal to a sweep electrode uniformly using one input pin without considering a size of a display panel has a problem.

According to an embodiment of the disclosure, the number of sweep signal input pins is changed depending on a size of a display panel, and accordingly, a deviation in sweep signal in the display panel due to a deviation in RC load in the sweep electrode may be reduced.

Specifically, according to an embodiment of the disclosure, in a case where the display panel 100 has a first size, a first number of the input pins, to which the sweep signal is applied, may be provided, and in a case where the display panel has a second size greater than the first size, a second number of the input pins which is greater than the first number of the input pins may be provided.

For example, only one sweep signal input pin is used in the display panel 100 used in a small-sized display apparatus such as a smart watch or the like, and a larger number of sweep signal input pins are suitably disposed in the sweep electrode, as the size of the display panel 100 increases like a tablet, a notebook, a TV for home use, a large-sized TV, or the like, and accordingly, a deviation in RC load for each region of the sweep electrode may be suitably adjusted so that a deviation in luminance does not occur.

Hereinafter, a structure of the sweep electrode according to various embodiments of the disclosure will be described with reference to FIGS. 7A to 9B.

Figure 7A:
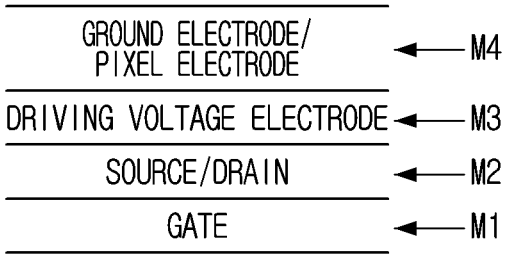
FIG. 7A is a structural view of metal layers according to an embodiment.

According to an embodiment of the disclosure, the display panel 100 may have a stacked structure including a plurality of metal layers. FIG. 7A is a structural view of metal layers included in the display panel 100 according to an embodiment of the disclosure.

Referring to FIG. 7A, transistors included in all circuits included in the TFT layer 40 described above may be formed in a first metal layer M1 and a second metal layer M2.

Specifically, gate electrodes, that is, gate terminals of the transistors may be formed in the first metal layer M1, and data electrodes, that is, source terminals and drain terminals of the transistors may be formed in the second metal layer M2.

Meanwhile, electrodes for supplying a power for operations to various circuits configured by the transistors included in the first and second metal layers M1 and M2 may be formed in a third metal layer M3 and a fourth metal layer M4.

Specifically, the third metal layer M3 may include an electrode for supplying the driving voltage (VDD). Particularly, the third metal layer M3 may include an electrode for supplying the driving voltage (VDD) to the PWM pixel circuit 120.

The fourth metal layer M4 may include an electrode for supplying a ground voltage (VSS). In addition, electrodes for connecting the PWM pixel circuit 120 and the inorganic light emitting element 110 to each other, that is, pixel circuits 1 and 2 may be formed in the fourth metal layer M4.

A material of the first to fourth metal layers M1 to M4 may be a conductive metal, but there is no limitation thereto, and any metallic material used in manufacturing a TFT having a laminated structure may correspond to the material of the first to fourth metal layers M1 to M4. Details regarding this does not relate to the gist of the disclosure, and therefore, the detailed description thereof will be omitted.

Figure 7B:
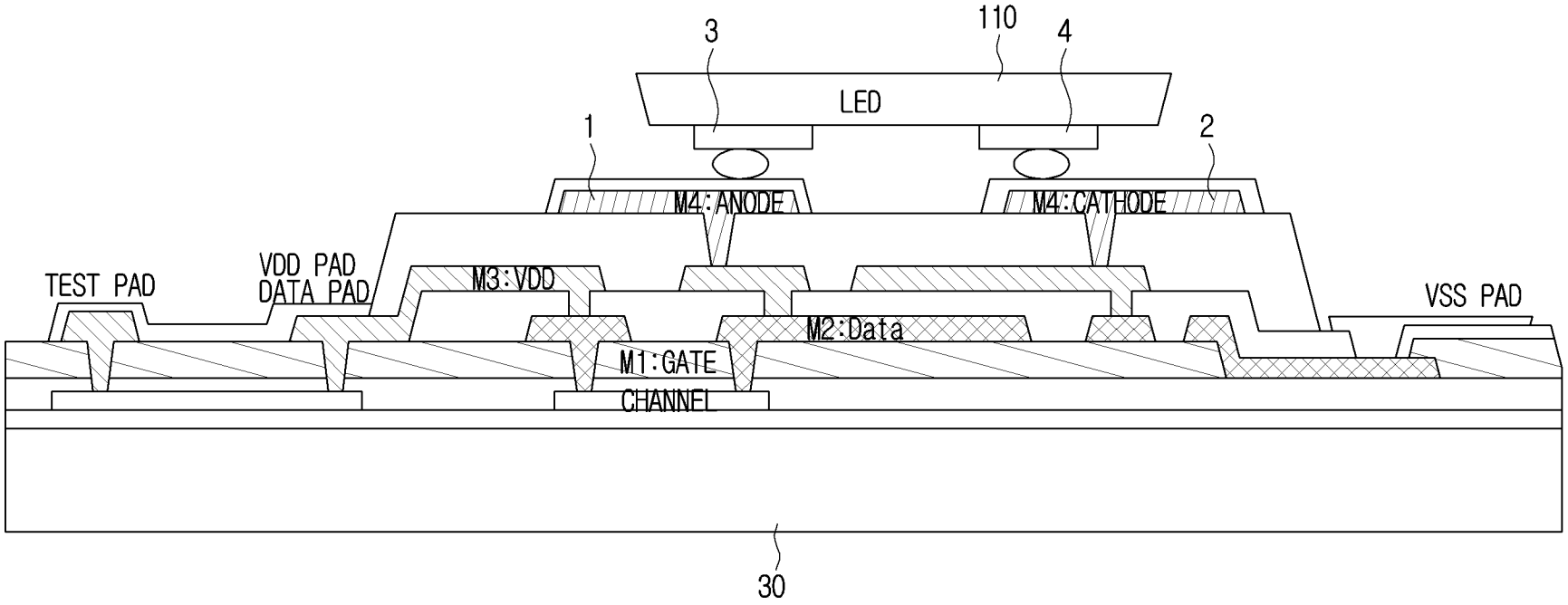
FIG. 7B is a detail view of metal layers according to an embodiment.

FIG. 7B is a view showing the stacked structure of the TFT of the display panel 100 according to an embodiment of the disclosure in detail of the disclosure. Referring to FIG. 7B, the first to fourth metal layers M1 to M4 described above may be formed on the substrate 30.

For example, a semiconductor channel layer may be formed on the glass substrate 30. The channel layer may be configured with various materials such as amorphous silicon (a-Si), low-temperature polysilicon (LTPS), or an oxide.

The first metal layer M1 including the gate electrode of the transistor is formed on the channel layer, and the channel layer is opened or closed in accordance with a voltage applied to the gate electrode. Accordingly, a flow of data is controlled between the source and drain terminals formed in the second metal layer M2.

Meanwhile, as described above, the driving voltage (VDD) electrode is formed on the layer M3, the pixel electrodes 3 and 4 are respectively formed on the layer M4, and the inorganic light emitting element 110 may be mounted on the pixel electrodes 3 and 4.

Figure 8A:
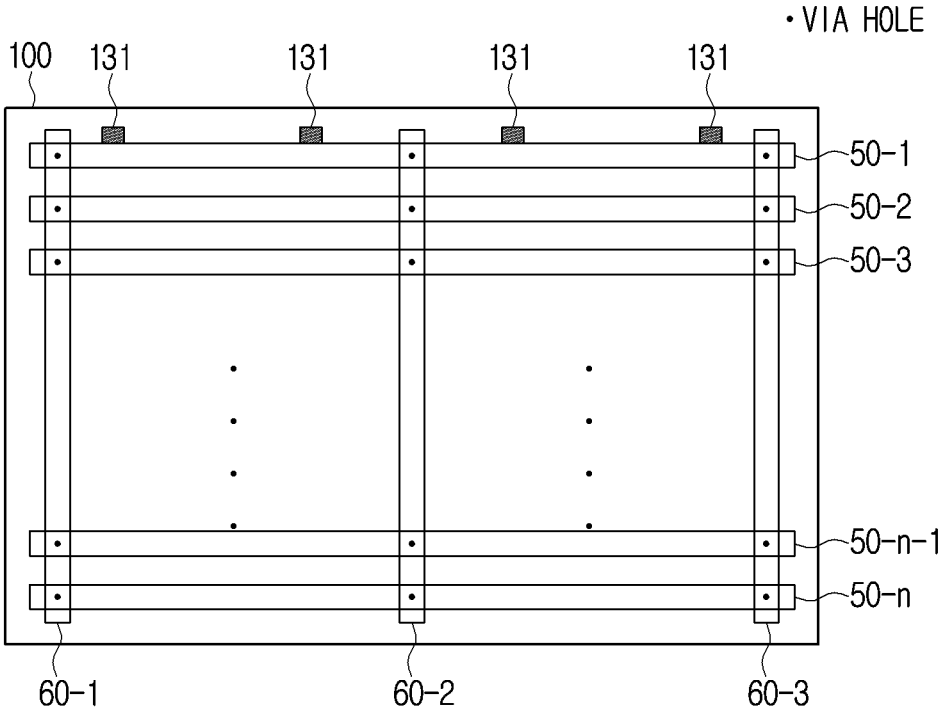
FIG. 8A is an exemplary view of a sweep electrode according to an embodiment.

FIG. 8A is an exemplary view of the sweep electrode according to an embodiment of the disclosure. Referring to FIG. 8A, the sweep electrode 130 of the display panel 100 may include a plurality of first metal lines 50-1 to **50-*n* disposed on the first metal layer M1, and a plurality of second metal lines 60-1 to 60-3 which are disposed on the second metal layer M2 and connect the plurality of first metal lines 50-1 to 50-*n*** to each other.

The plurality of first metal lines 50-1 to **50-*n* and the plurality of second metal lines 60-1 to 60-3** may be connected to each other through via holes.

Although not shown in the drawing, the PWM pixel circuit 120 corresponding to each subpixel included in the display panel 100 may be connected to the sweep electrode at a position of each subpixel in the display panel 100. Accordingly, the PWM pixel circuit 120 may receive the sweep signal through the sweep electrode 130.

Specifically, the gate terminal of the driving transistor 121 included in the PWM pixel circuit 120 may be connected to the plurality of first metal lines 50-1 to **50-*n*. Accordingly, the voltage of the gate terminal of the driving transistor 121 may change depending on a change of the sweep signal applied through the sweep electrode 130**.

According to an embodiment of the disclosure, at least one input pin 131, the number of which may vary depending on the size of the display panel 100, may be connected to the sweep electrode 130. As described above, the driving unit 200 may provide the sweep signal to the sweep electrode 130 through the input pin 131. For this, the driving unit 200 provides the same sweep signal to each of input pin 131.

FIG. 8A shows an example in which four input pins 131 are connected to the first metal line 50-1 provided in an edge region among the plurality of first metal lines 50-1 to **50-*n*. As described above, in a case where the plurality of input pins 131 are connected to the sweep electrode 130, the resistance component at each point of the sweep electrode 130 with respect to each input pin 131 is reduced, thereby reducing RC deviation for each region of the sweep electrode 130**, compared to a case where one input pin is provided. Therefore, according to an embodiment of the disclosure, a problem regarding the deviation in luminance due to the RC deviation in the sweep electrode of the sweep signal may be solved.

As shown in FIG. 8A, the four input pins 131 may be spaced apart at regular intervals and connected to the first metal line 50-1, but the embodiment is not limited thereto.

In addition, the number of input pins 131 is not limited to four. Any number of input pins 131 may be connected to the sweep electrode 130 depending on the size of the display panel 100.

Figure 8B:
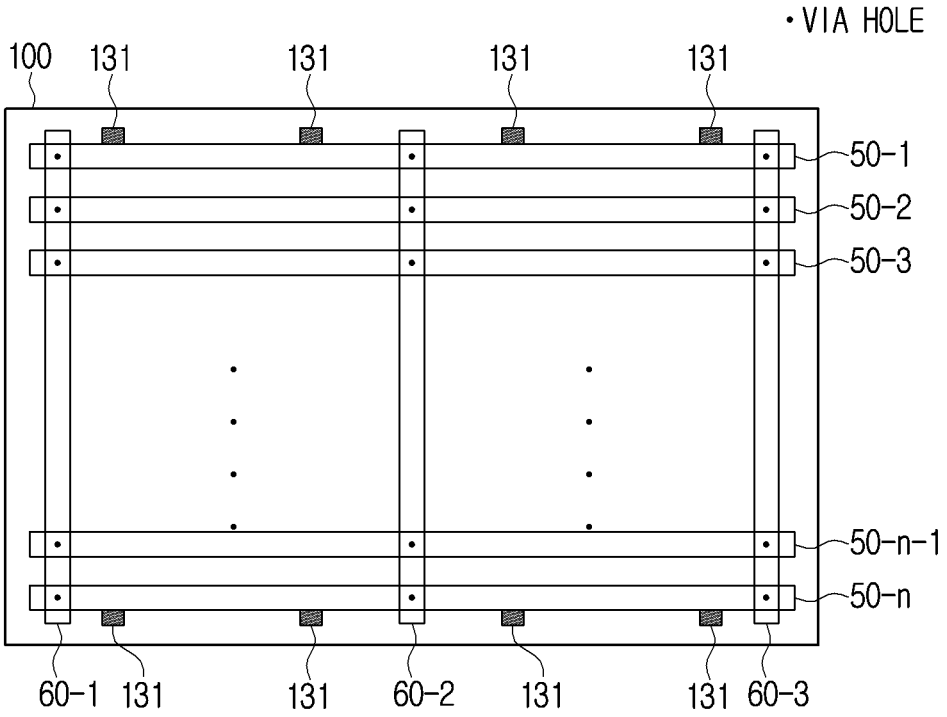
FIG. 8B is an exemplary view of a sweep electrode according to another embodiment.
Figure 8C:
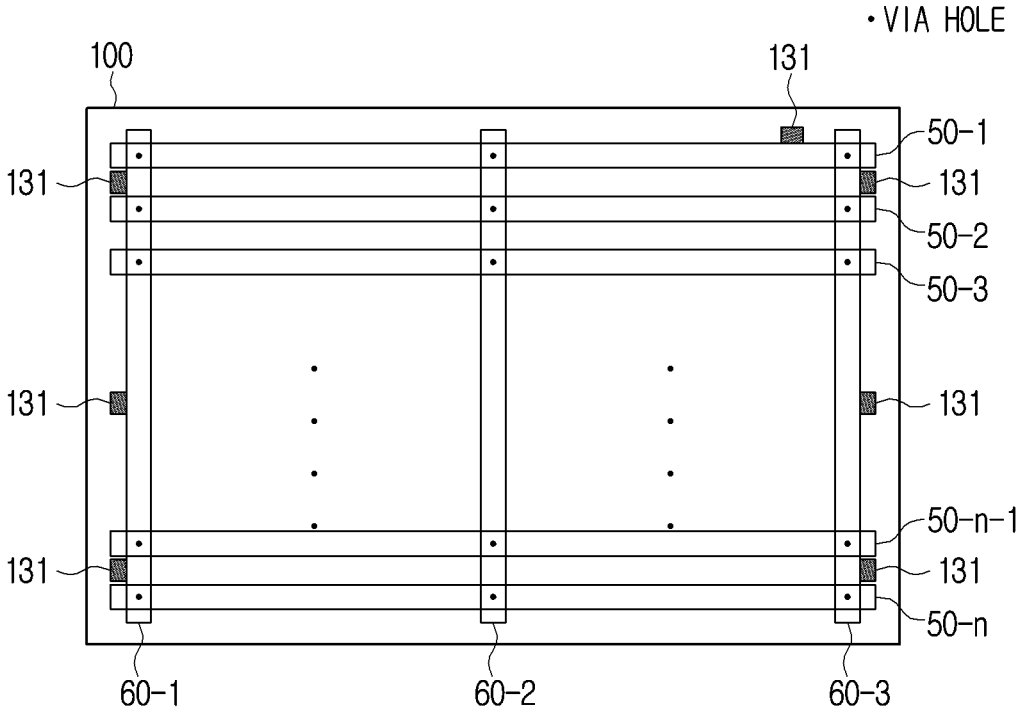
FIG. 8C is an exemplary view of a sweep electrode according to still another embodiment.

In addition, FIG. 8A shows an example of three second metal lines 60-1 to 60-3, but there is no limitation thereto, and two or four or more second metal lines may be connected to the first metal lines 50-1 to **50-*n* through via holes, and the same applies to FIGS. 8B, 8C, and 9**B.

FIG. 8B is an exemplary view of a sweep electrode according to another embodiment of the disclosure. Referring to FIG. 8B, the display panel 100 further includes four input pins 131 connected to another first metal line **50-*n* provided in an edge region among the first metal lines 50-1 to 50-*n*, compared to the display panel 100 in FIG. 8**A.

The input pins 131 connected to the two first metal lines 50-1 and **50-*n* in the edge regions may be connected symmetrically to each other, as shown in FIG. 8**B, but there is no limitation thereto.

As described above, when the number of input pins increases, the resistance component at each point of the sweep electrode 130 with respect to the position of each input pin is further reduced, thereby further reducing RC deviation for each region of the sweep electrode 130.

FIG. 8C is an exemplary view of a sweep electrode according to still another embodiment of the disclosure. According to an embodiment of the disclosure, as shown in FIG. 8C, the input pins 131 receiving the sweep signal may be connected to at least one of the metal lines 60-1 and 60-3 provided in edge regions among the plurality of second metal lines 60-1 to 60-3.

The number of input pins 131 connected to the second metal lines 60-1 and 60-3 shown in FIG. 8C or the relative interval between the input pins 131 shown in FIG. 8C is merely an embodiment, and there is no limitation thereto.

The embodiments shown in FIGS. 8A to 8C do not limit the embodiment with the respectively shown embodiments. According to an embodiment, the input pins 131 shown in FIG. 8C may be additionally connected to the second metal lines 60-1 and 60-3 shown in FIG. 8A or 8B.

Meanwhile, as described above, transistors configuring various circuits are formed and various signal lines are disposed on the first metal layer M1 and the second metal layer M2. Accordingly, the space thereof is relatively narrow, and a thickness of the first metal line or the second metal line may be formed to be thin.

Accordingly, the number of input pins 131 may not be increased infinitely in order to reduce the RC delay for each region of the sweep electrode 130, and even when the number of input pins 131 is increased, there may be a limit to reduce the RC deviation in the sweep electrode 130 due to a thin thickness of the first and second metal lines.

Thus, according to an embodiment of the disclosure, such a problem may be solved by forming a shorting bar having a relatively large area on the third or the fourth metal layer M3 or M4 and connecting the shoring bar to the first or second metal lines through via holes.

Figure 9A:
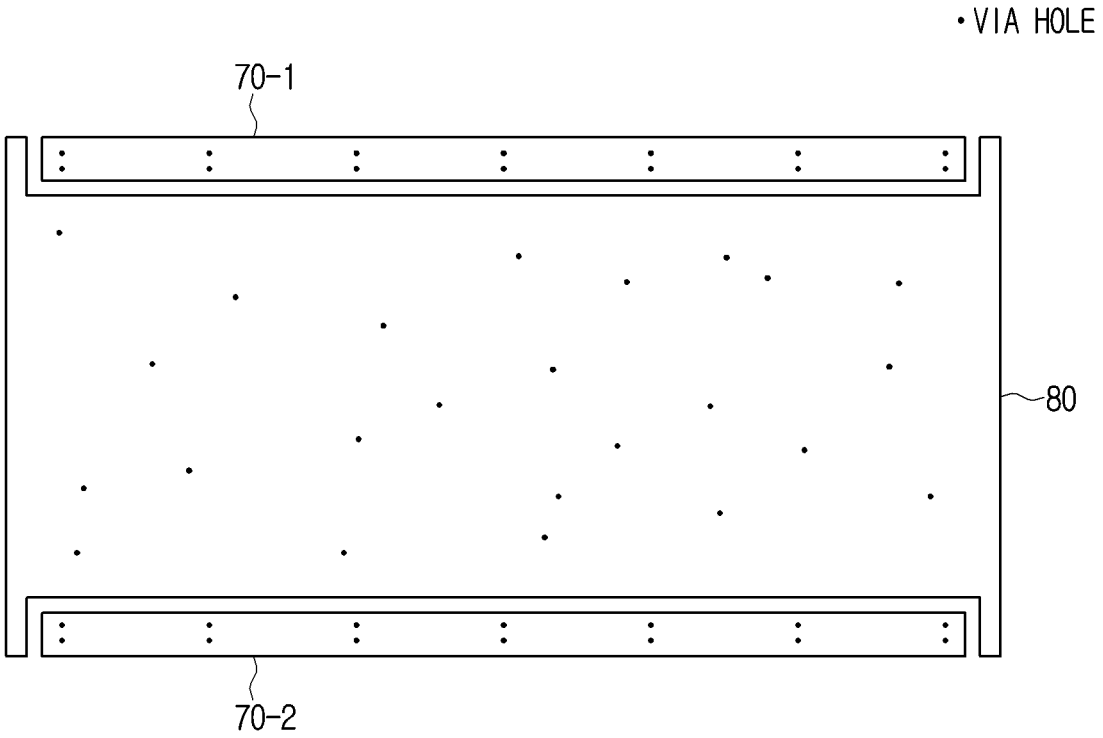
FIG. 9A is an exemplary view showing a shorting bar according to an embodiment.

FIG. 9A is an exemplary view showing the third metal layer M3 according to an embodiment of the disclosure. As described above, an electrode 80 for supplying the driving voltage (VDD) is formed on the third metal layer M3. Shorting bars 70-1 and 70-2 may be formed on the third metal layer M3, as shown in FIG. 9A.

The shorting bars 70-1 and 70-2 may be provided in edge regions of the third metal layer M3. FIG. 9A shows that the shorting bars 70-1 and 70-2 are provided symmetrically to each other in upper and lower edge regions of the third metal layer M3, but the embodiment is not limited thereto. According to an embodiment, the shorting bars may be provided in any combinations of upper, lower, right, and left edge regions of the third metal layer M3.

The shorting bars may be provided in only any one of the upper, lower, right, and left edge regions, two shorting bars may be symmetrically provided in right and left edge regions, or two or three shorting bars may be asymmetrically provided in upper and right edge regions or lower, left, and right edge regions.

The shorting bar may have an area larger than that of the first metal line of the first metal layer M1 or the second metal line of the second metal layer M2 described above.

Figure 9B:
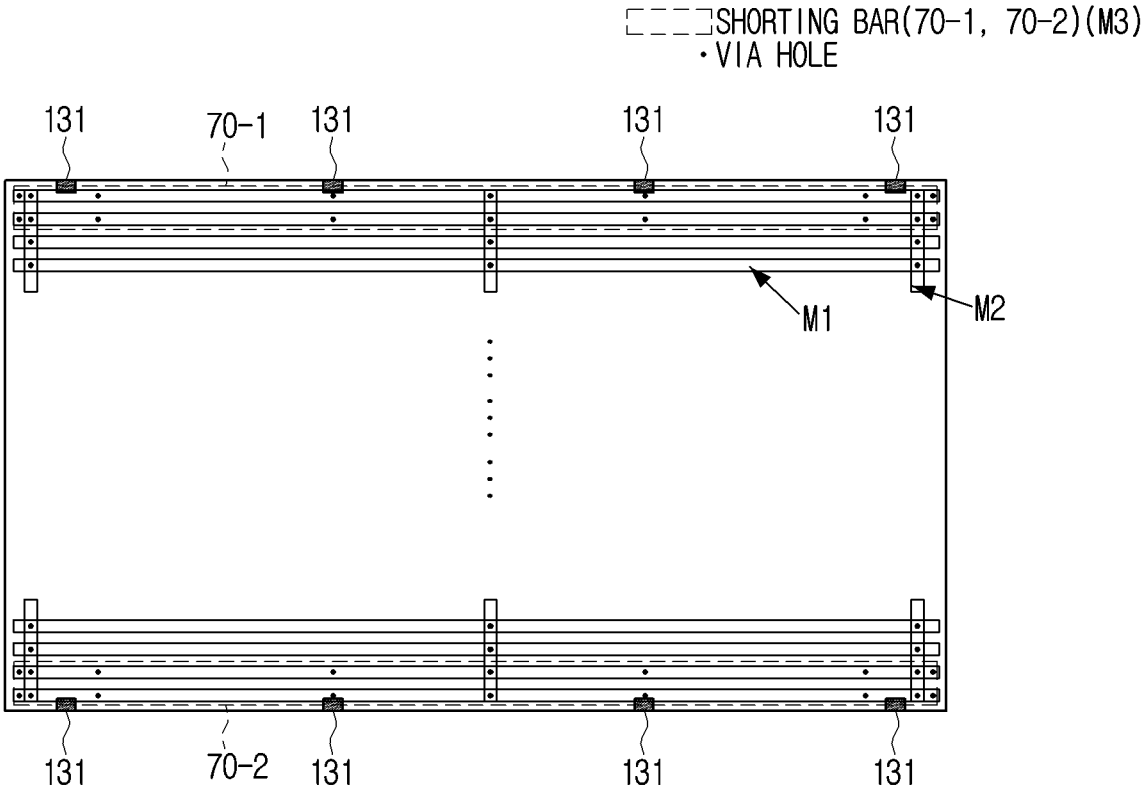
FIG. 9B is an exemplary view of a sweep electrode according to still another embodiment.

FIG. 9B is an exemplary view of the sweep electrode 130 according to still another embodiment of the disclosure. As shown in FIG. 9B, the sweep electrode 130 may further include shorting bars 70-1 and 70-2 formed on the third metal layer M3, in addition to the plurality of first metal lines formed on the first metal layer M1 and the plurality of second metal lines formed on the second metal layer M2.

FIG. 9B shows that each of the shorting bars 70-1 and 70-2 has an area corresponding to the two first metal lines and is connected to the plurality of first metal lines through via holes. The same sweep signal input through each of the plurality of input pins 131 is transmitted to the entire sweep electrode 130 in a overlapped manner through the shorting bars 70-1 and 70-2 having a relatively large area (that is, low resistance component), and accordingly, the RC deviation for each region of the sweep electrode 130 may be more effectively reduced.

In addition, by increasing the number of via holes formed between the shorting bars 70-1 and 70-2 and the first metal lines, the effect equivalent to an effect of adding the number of input pins to the sweep electrode 130 may be obtained by the increased number of via holes.

FIG. 9B shows an example in which the input pins 131 are connected to the first metal line of the first metal layer M1, but the embodiment is not limited thereto. For example, at least one input pin may be connected to the shorting bars 70-1 and 70-2 and the sweep signal input through the input pin connected to the shorting bars 70-1 and 70-2 may be transmitted to the first and second metal lines through via holes.

That is, according to various embodiments of the disclosure, at least one input pin may be connected to the first metal line, may be connected to the second metal line, or may be connected to the shorting bars. According to an embodiment, at least one input pin may be connected to the first metal lines and the shorting bars, may be connected to the second metal lines and the shorting bars, or may be connected to all of the first metal lines, the second metal lines, and the shorting bars.

FIGS. 9A and 9B shows an example in which the shorting bar is formed on the third metal layer, but there is no limitation thereto. That is, as described above regarding the third metal layer M3, the shorting bar may be formed on the fourth metal layer M4 on which the ground voltage (VS S) electrode and the pixel electrode are formed.

Hereinabove, the metal line having a relatively larger area formed on the third or fourth metal layer M3 or M4 is referred to as the shorting bar, but the term, shorting bar, may not be limitedly used.

That is, in some cases, regardless of the metal layers, the metal line which is directly connected to at least one input pin 131 and initially receives the sweep signal from the input pin 131 may be referred to as a shorting bar.

For example, the metal line connected to at least one input pin 131, among the plurality of first metal lines 50-1 to **50-*n* of the first metal layer M1 and the plurality of second metal lines 60-1 to 60-3 of the second metal layer M2 configuring the sweep electrode 130**, may also be referred to as a shorting bar.

According to an embodiment of the disclosure, in a case where a plurality of sweep signal input pins are provided, split driving may be performed by splitting the display panel into a plurality of sweep blocks.

Specifically, according to an embodiment of the disclosure, the sweep electrode 130 may be provided in the plurality of block units. The number of input pins 131 is more than one and the plurality of input pins 131 may be connected symmetrically to each other for each of the plurality of sweep electrode blocks.

Figure 10:
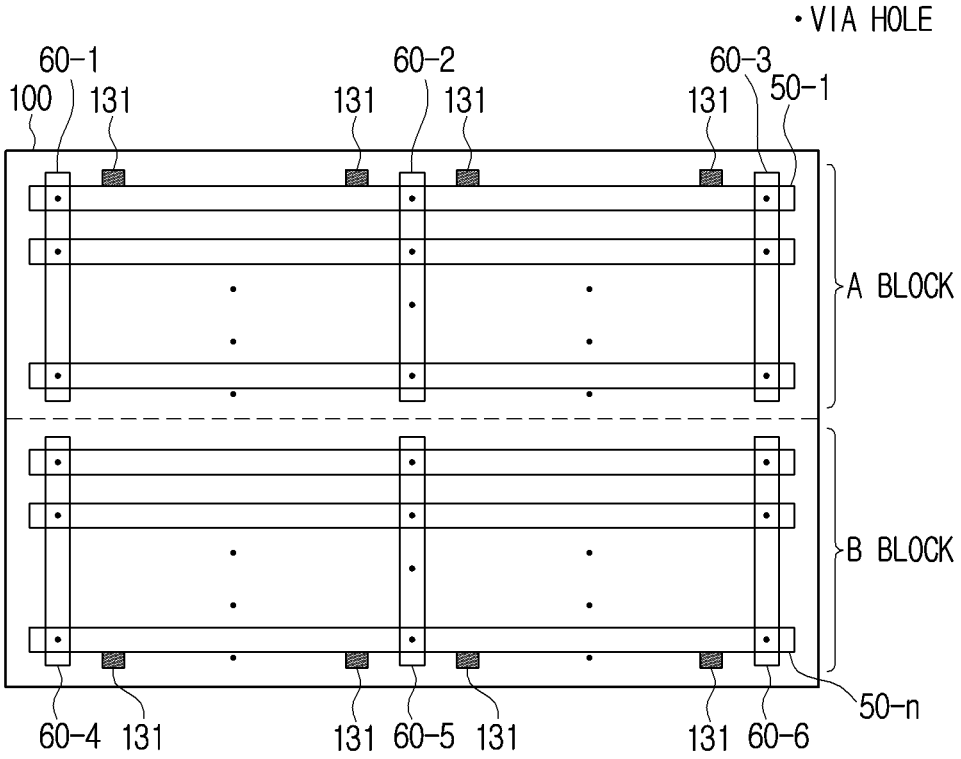
FIG. 10 is an exemplary view showing sweep electrode blocks according to an embodiment.

FIG. 10 shows an example of the sweep electrode split into two blocks (A block and B block). As shown in FIG. 10, the sweep electrode 130 may include the plurality of first metal lines 50-1 to **50-*n* formed on the first metal layer M1, and the plurality of input pins 131 are spaced part at regular intervals and respectively connected to the first metal lines 50-1 and 50-*n* in the edge regions. This is the same as shown in FIG. 8**B.

However, FIG. 10 shows that second metal lines 60-1 to 60-6 formed on the second metal layer M2 are split for each sweep electrode block. That is, unlike the description in FIG. 8B, FIG. 10 shows that the second metal lines 60-1 to 60-3 are connected to the first metal lines through via holes in the A block, and the second metal lines 60-4 to 60-6 are connected to the first metal lines through via holes in the B block.

Accordingly, the sweep electrodes 130 included in the A block and the B block are electrically separated from each other, the sweep signal applied through the input pins 131 connected to the first metal line 50-1 included in the A block is not transmitted to the B block, and the sweep signal applied through the input pins 131 connected to the first metal line **50-*n*** included in the B block is not transmitted to the A block.

Thus, the driving unit 200 may perform the split driving of the display panel 100 by providing the sweep signal at different times through the input pins connected to each block, in the sweep electrode block units.

FIGS. 11A to 11D are views for describing operations relating to the split driving of the display panel 100.

Figure 11A:
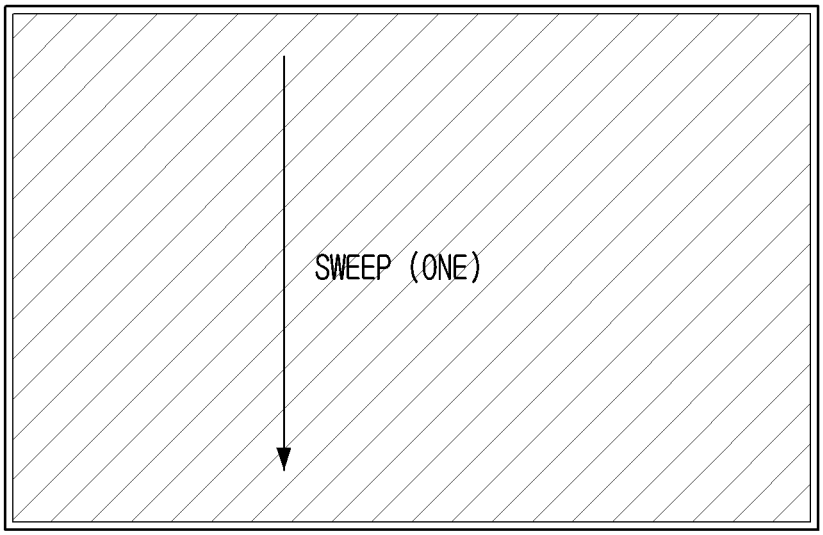
FIG. 11A is a view showing a general PWM driving system.
Figure 11A:
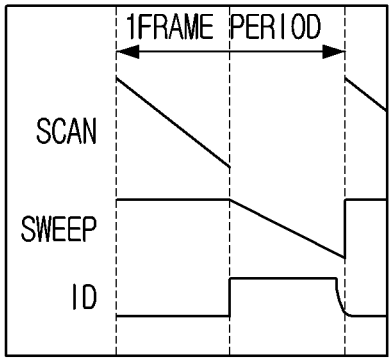

FIG. 11A is a view showing a general PWM driving system. In general, when displaying one image frame, the PWM driving system is operated separately in a scan period for setting a PWM data voltage for each line, and an emission period for allowing emission of a light emitting element according to the set PWM data voltage. At this time, the sweep signal is applied to the entire region of the display panel at the same time in the emission period.

As described above, in a case of performing the driving separately in the scan period and the emission period, it is difficult to ensure sufficient scan time. Accordingly, a high-speed transmission of the PWM data is required for peripheral circuits (for example, TCON, data drivers, and the like) for driving the PWM pixel circuit, and this causes an increase in cost for implementing the peripheral circuits.

Thus, according to an embodiment of the disclosure, when the display panel 100 is divided into the plurality of sweep electrode block units and the split driving of the display panel 100 is performed in the block unit, the entire period of time of one frame may be used as the scan period. Therefore, the afore-mentioned problems may be solved.

Figure 11B:
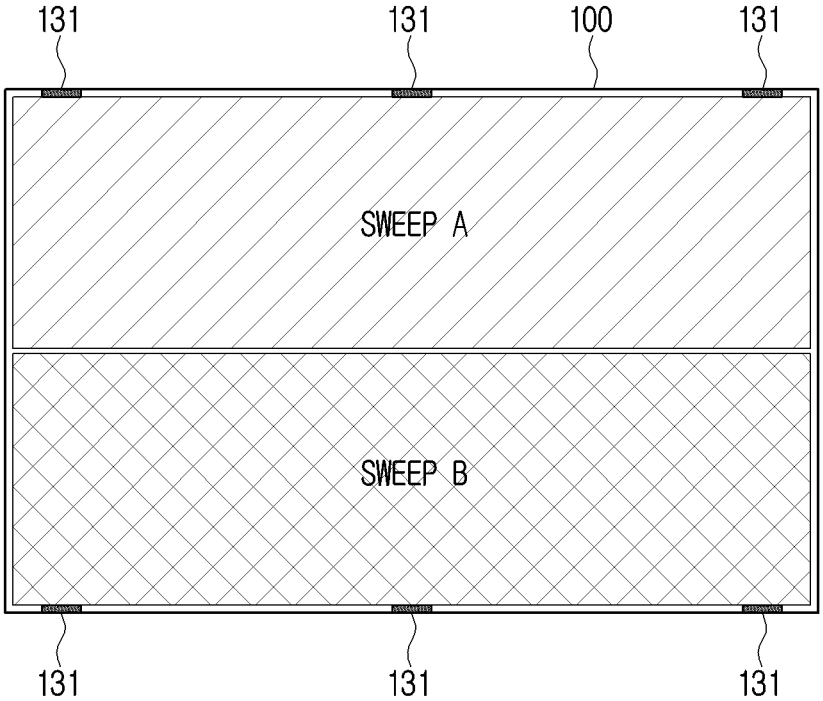
FIG. 11B is a view showing split driving of a sweep electrode block according to an embodiment.
Figure 11B:
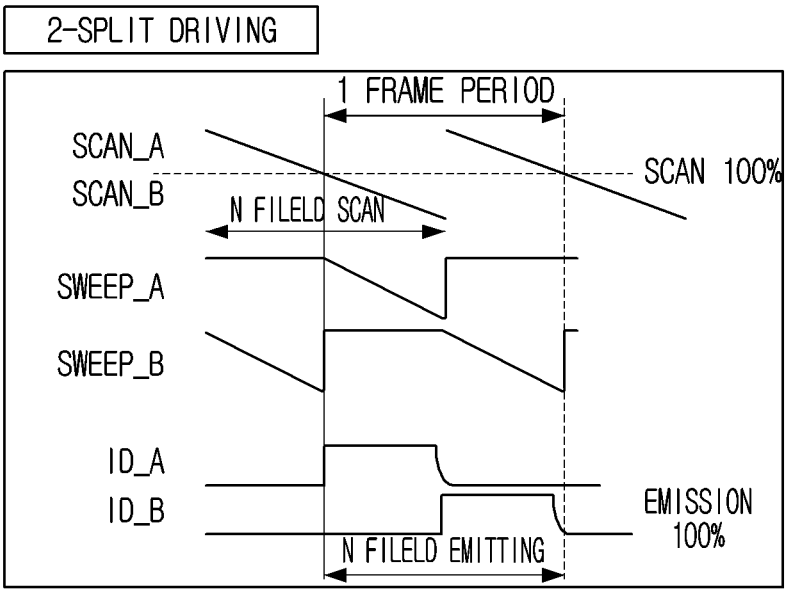

FIG. 11B is a view showing an example of dividing the sweep electrode 130 into two blocks and performing the split driving of the display panel 100 in the divided sweep electrode block units according to an embodiment of the disclosure.

In the display panel 100 of FIG. 11B, the sweep electrode structure shown in FIG. 10 may be used. As shown in FIG. 11B, the B block is operated in the emission period while the A block is operated in the scan period, and the B block is operated in the scan period while the A block is operated in the emission period, and accordingly, the entire period of time of one image frame may be used as the scan period.

Figure 11C:
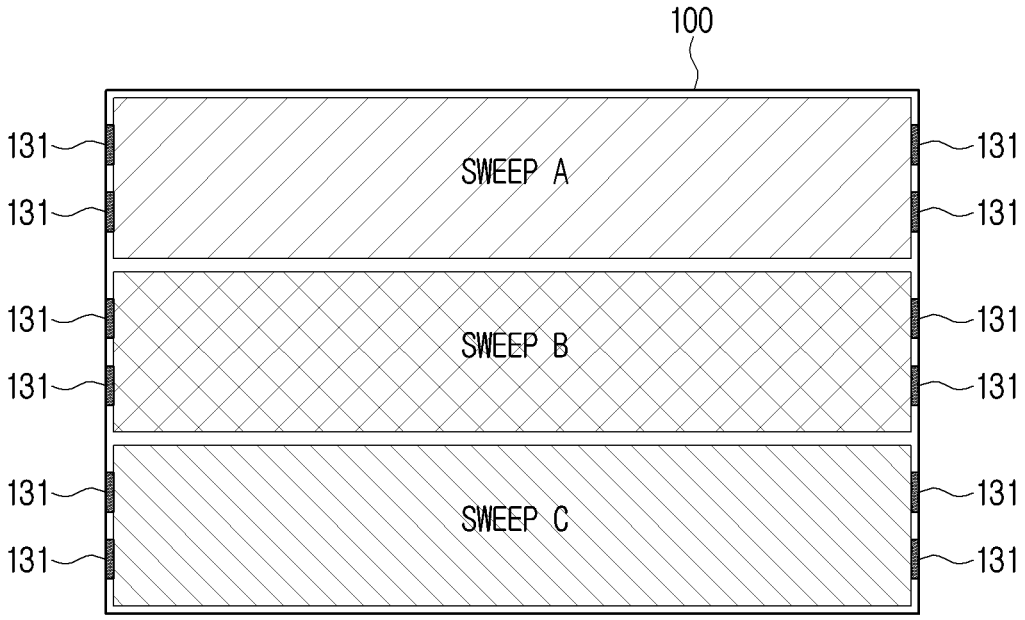
FIG. 11C is a view showing split driving of a sweep electrode block according to another embodiment.
Figure 11C:
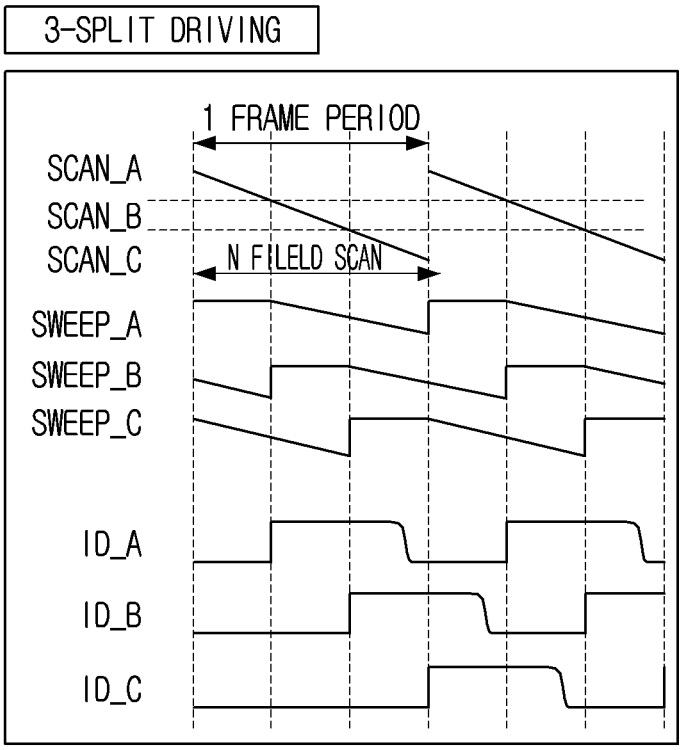

FIG. 11C shows an example of dividing the sweep electrode 130 into three blocks and performing the split driving of the display panel 100 in the divided sweep electrode block units according to another embodiment of the disclosure. FIG. 11C also shows that the scan periods of the A, B, and C blocks form the entire time of one image frame.

As described above, when the scan period increases, for example, a data transmission speed from a TCON to a data driver may be decreased, thereby reducing cost for circuits.

The display panel 100 of FIGS. 11B and 11C shows that the number of sweep input pins 131 is more than one and the sweep input pins 131 are disposed symmetrically to each other. The driving unit 200 may provide sweep signals at different times in the sweep electrode block units, through the input pins 131 connected to each of the divided blocks.

Figure 11D:
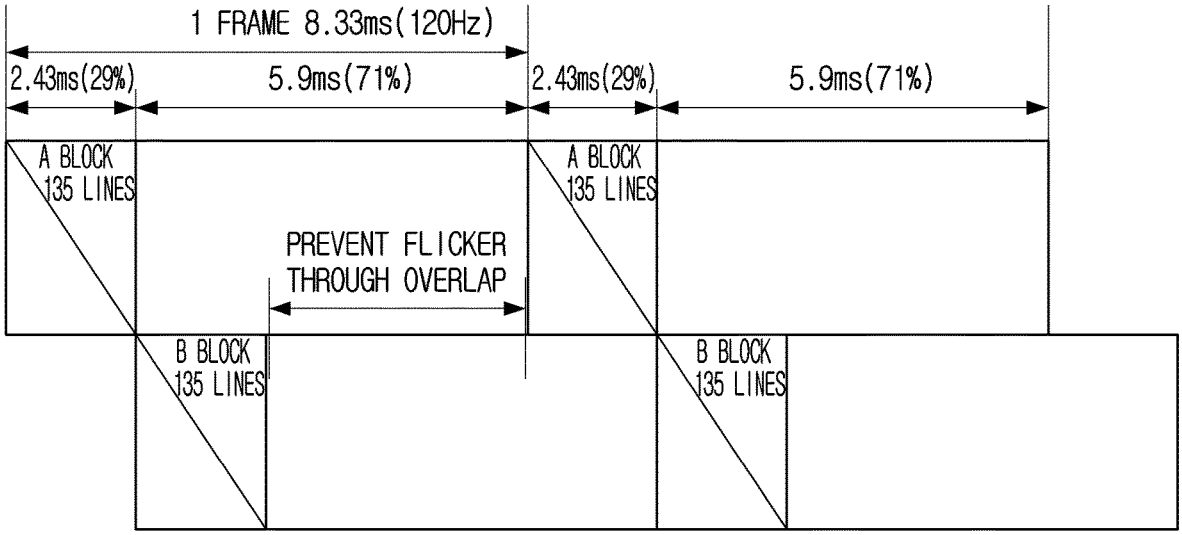
FIG. 11D is a view showing split driving of a sweep electrode block according to still another embodiment.

FIG. 11D is a view showing the split driving of the sweep electrode blocks according to still another embodiment of the disclosure. At the time of 2-split driving shown in FIG. 11B, flicker may occur, in a case where the driving is performed by setting each duty ratio of the scan period and the emission period as 50%.

Accordingly, according to an embodiment of the disclosure, as shown in FIG. 11D, the driving operation is performed in one frame period of time by setting the duty ratio of the scan period as 29% and the duty ratio of the emission period as 71%, and accordingly, a certain part of the emission period between the two blocks may be overlapped, thereby removing the possibility of occurrence of flicker.

Figure 12:
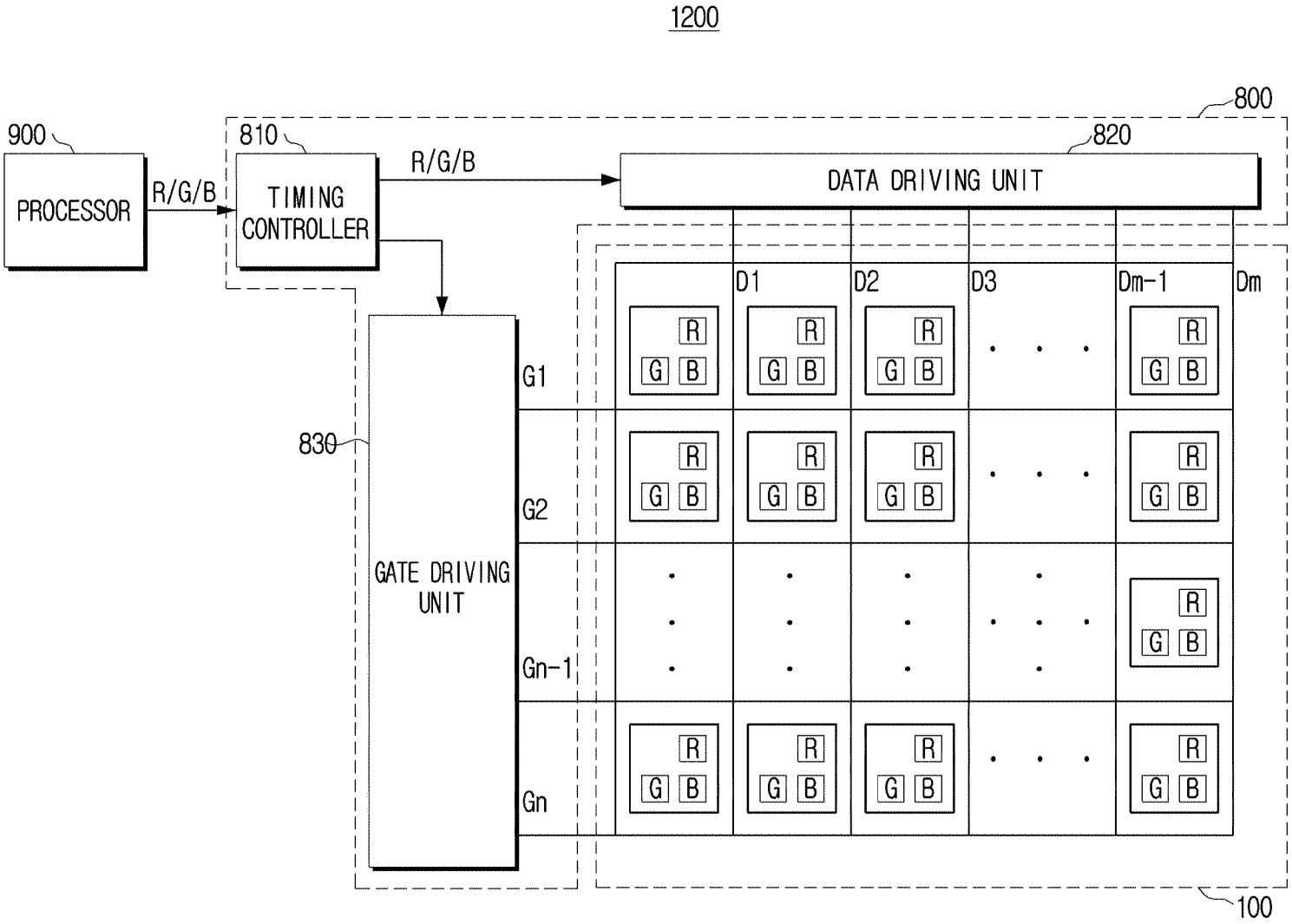
FIG. 12 is a configuration view of a display apparatus according to an embodiment.

FIG. 12 is a configuration view of a display apparatus according to an embodiment of the disclosure. Referring to FIG. 12, a display apparatus 1200 includes the display panel 100, a panel driving unit 800, and a processor 900.

The display panel 100 may include the plurality of the inorganic light emitting elements 110 constituting the plurality of subpixels, and the plurality of pixel circuits 120 and 150 for driving each of the inorganic light emitting elements 110.

Specifically, in the display panel 100, gate lines G1 to Gn and data lines D1 to Dm are formed to cross each other and the pixel circuits 120 and 150 may be formed regions provided by the crossing. For example, each of the plurality of pixel circuits 120 and 150 may be configured so that adjacent R, G, and B subpixels constitute one pixel, but there is no limitation thereto.

Particularly, the display panel 100 may include the sweep electrode 130 according to various embodiments described above. At least one input pin 131 may be connected to the sweep electrode 130, and the sweep signal input through the input pin 130 is transmitted to the plurality of PWM pixel circuits 120 through the sweep electrode 130.

The number of input pins may vary depending on the size of the display panel 100.

The panel driving unit 800 may drive the display panel 100, more specifically, each of the plurality of pixel circuits 120 and 150 according to control of the processor 900, and may include a timing controller 810, a data driving unit 820, a gate driving unit 830, and a sweep signal providing circuit (not shown).

The timing controller 810 may receive an input signal (IS), a horizontal synchronization signal (Hsync), a vertical synchronization signal (Vsync), and a main clock signal (MCLK), generates an image data signal, a scanning control signal, a data control signal, a light emission control signal, and the like, and provides the signals to the display panel 100, the display driving unit 820, the gate driving unit 830, the sweep signal providing circuit (not shown), and the like.

In particular, the timing controller 810 may apply various control signals to the pixel circuits 120 and 150 according to various embodiments of the disclosure. In addition, according to an embodiment, the timing controller 810 may apply a control signal (MUX Sel R, G, B) for selecting one subpixel from the R, G, and B subpixels to the display panel 100.

The data driving unit 820 (or source driver or data driver) is a unit for generating data signals, receives image data or the like of a R/G/B component from the processor 900 and generates data voltages (for example, PWM data voltage and PAM data voltage). In addition, the data driving unit 820 may apply the generated data signals to the display panel 100.

The gate driving unit 830 (or gate driver) is a unit for generating various control signals such as a scan signal for selecting a pixel arranged in a matrix form for each line, and transmits the generated various control signals to a certain line (or certain transverse line) or all of the lines of the display panel 100.

In addition, the gate driving unit 830 may apply the driving voltage (VDD) to driving voltage terminals of the pixel circuits 120 and 150 according to an embodiment.

The sweep signal providing circuit (not shown) may provide a sweep signal to the sweep electrode 130 through at least one input pin connected to the sweep electrode 130 of the display panel 100.

The data driving unit 820, the gate driving unit 830, and the sweep signal providing circuit (not shown) may constitute the driving unit 200 as described above. As described above, both or one of the data driving unit 820 and the gate driving unit 830 may be implemented to be included in the TFT layer 40 formed on one surface of the substrate 30 of the display panel 100 or implemented as a separate semiconductor IC and disposed on another surface of the substrate 30. The sweep signal providing circuit (not shown) may be disposed on a main PCB as a separate IC together with the timing controller 810 or the processor 900, but the implementation example is not limited thereto.

One display module 1000 including the display panel 100 and the driving unit 200 may constitute one display apparatus 1200. In addition, according to an embodiment, a combination of the plurality of display modules 1000 may constitute one display apparatus 1200.

The processor 900 controls a general operation of the display apparatus 1200. In particular, the processor 900 may control the panel driving unit 800 to drive the display panel 100.

For this, the processor 900 may be implemented as one or more of a central processing unit (CPU), a micro-controller, an application processor (AP) or a communication processor (CP), and an ARM processor.

In FIG. 12, the processor 900 and the timing controller 810 have been described as separate components, but the timing controller 810 may execute the function of the processor 900, without the processor 900, according to an embodiment.

Figure 13:
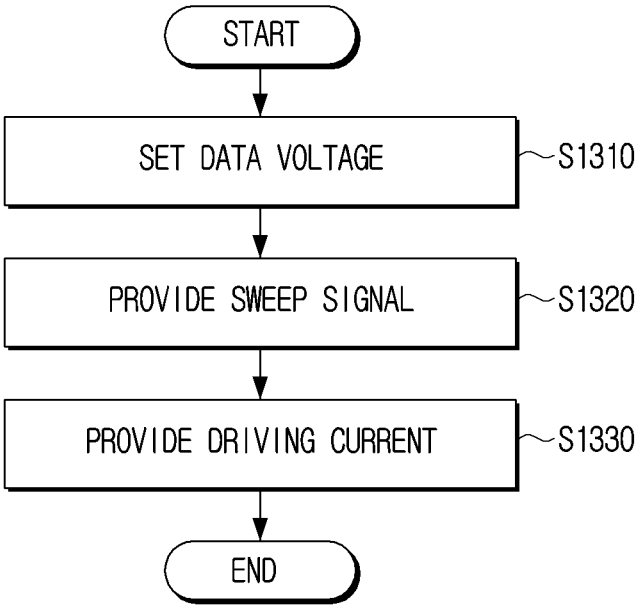
FIG. 13 is a flowchart showing a driving method of a display module according to an embodiment.

FIG. 13 is a flowchart showing a driving method of the display module 1000 according to an embodiment of the disclosure. In the description of FIG. 13, the detailed descriptions of the repeated parts as described above will be omitted.

The display module 1000 may include the display panel 100 including the inorganic light emitting element 110, the sweep electrode 130 connected to at least one input pin 131, and the PWM pixel circuit 120. The number of input pins 131 may vary depending on the size of the display panel 100.

Specifically, in a case where the display panel 100 has a first size, a first number of the input pins 131 may be provided, and in a case where the display panel 100 has a second size greater than the first size, a second number of the input pins 131 which is greater than the first number may be provided.

Referring to FIG. 13, the display module 1000 may set a PWM data voltage in the gate terminal of the driving transistor 121 included in the PWM pixel circuit 120 (S1310).

Hereinafter, the display module 1000 may provide the sweep signal to the sweep electrode 130 through at least one input pin 131 (S1320).

Accordingly, when the sweep signal is applied to the PWM pixel circuit 120 through the sweep electrode 130, the display module 1000 may change a voltage of the gate terminal of the driving transistor 121 according to the sweep signal and provide the driving current having a pulse width corresponding to the set PWM data voltage to the inorganic light emitting element 110 (S1330).

According to an embodiment of the disclosure, the sweep electrode 130 may be set in the plurality of block units and the plurality of input pins 131 may be connected to the sweep electrode blocks symmetrically to each other. In this case, the display module 1000 may provide the sweep signals at different times in the sweep electrode block units through the input pins 131 connected to each block.

As described above, according to various embodiments of the disclosure, the sweep electrode structure capable of uniformly providing the sweep signal may be provided. Thus, a problem regarding a deviation in luminance due to a deviation in RC load in the sweep electrode in the display module may be solved.

In addition, the high-speed data transmission of the peripheral circuits is not required due to an increase of the scan period, that is, data setting period, thereby reducing cost for constructing the peripheral circuits.

Meanwhile, various embodiments of the disclosure may be implemented as software including instructions stored in machine (e.g., computer)-readable storage media. The machine herein is an apparatus which invokes instructions stored in the storage medium and is operated according to the invoked instructions, and may include the display apparatus 1200 including the various display modules 1000 according to the embodiments described above.

In a case where the instruction is executed by a processor, the processor may execute a function corresponding to the instruction directly or using other elements under the control of the processor. The instruction may include a code generated by a compiler or executed by an interpreter. The machine-readable storage medium may be provided in a form of a non-transitory storage medium. Here, the term "non-transitory" merely mean that the storage medium is tangible while not including signals, and it does not distinguish that data is semi-permanently or temporarily stored in the storage medium.

According to an embodiment, the methods according to various embodiments of the disclosure may be provided to be included in a computer program product. The computer program product may be exchanged between a seller and a purchaser as a commercially available product. The computer program product may be distributed in the form of a machine-readable storage medium (e.g., compact disc read only memory (CD-ROM) or distributed online through an application store (e.g., PlayStore™). In a case of the on-line distribution, at least a part of the computer program product may be temporarily stored or temporarily generated at least in a storage medium such as a memory of a server of a manufacturer, a server of an application store, or a relay server.

Each of the elements (for example, a module or a program) according to various embodiments may be composed of a single entity or a plurality of entities, and some sub-elements of the abovementioned sub-elements may be omitted. The elements may be further included in various embodiments. Alternatively or additionally, some elements (e.g., modules or programs) may be integrated into one entity to perform the same or similar functions performed by each respective element prior to integration. Operations performed by a module, program, or other element, in accordance with various embodiments, may be performed sequentially, in a parallel, repetitive, or heuristically manner, or at least some operations may be performed in a different order, omitted, or may add a different operation.

The above description is merely illustrative of the technical spirit of the disclosure, and it will be understood by those skilled in the art that various changes and modifications may be made therein without departing from the spirit and scope of the disclosure. In addition, the embodiments according to the disclosure are not intended to limit but intended to describe the technical spirit of the disclosure, and the scope of the technical spirit of the disclosure is not limited by the embodiments. Therefore, the scope of the disclosure is to be construed according to the following claims, and all the technical spirits within the equivalent scope is within the scope of the appended claims.

What is claimed is:

1. A display module comprising:

a display panel including an inorganic light emitting device, a sweep electrode connected to input pins, and a pulse width modulation (PWM) pixel circuit; and a driving unit configured to provide a sweep signal to the sweep electrode through the input pins, wherein the PWM pixel circuit includes a driving transistor, and provides a driving current having a pulse width corresponding to a data voltage to the inorganic light emitting device by changing a voltage of a gate terminal of the driving transistor according to the sweep signal applied through the sweep electrode, wherein the display panel has a stacked structure comprising metal layers including a first metal layer and a second metal layer, wherein the sweep electrode includes a plurality of first metal lines disposed on the first metal layer of the metal layers and a plurality of second metal lines disposed on the second metal layer of the metal layers, the plurality of first metal lines being connected through the plurality of second metal lines, and wherein the input pins are connected to a metal line among the plurality of first metal lines and the plurality of second metal lines.

2. The module according to claim 1, wherein, based on the display panel having a first size, a first number of the input pins are provided in the display panel, and based on the display panel having a second size greater than the first size, a second number of the input pins which is more than the first number are provided in the display panel.

3. The module according to claim 1, wherein, the driving unit provides the same sweep signal through each of the input pins spaced apart at regular intervals.

4. The module according to claim 1, wherein the metal layers further include a third metal layer and a fourth metal layer, wherein the first metal layer includes a gate terminal of the driving transistor, wherein the second metal layer includes source and drain terminals of the driving transistor, wherein the third metal layer includes an electrode for supplying a driving voltage to the PWM pixel circuit, and wherein the fourth metal layer includes an electrode for connecting the PWM pixel circuit and the inorganic light emitting device to each other.

5. The module according to claim 4, wherein the gate terminal of the driving transistor is connected to a metal line among the plurality of first metal lines.

6. The module according to claim 5, wherein the metal line connected to the input pins is provided in an edge region among the plurality of first metal lines and the plurality of second metal lines.

7. The module according to claim 5, wherein the sweep electrode further comprises a shorting bar disposed on at least one of the third metal layer and the fourth metal layer, and connected to at least one metal line of the plurality of first metal lines through at least one via hole.

8. The module according to claim 7, wherein the shorting bar is provided in an edge region of at least one metal layer of the third metal layer and the fourth metal layer, and is connected to a metal line provided in an edge region among the plurality of first metal lines through the via hole, and wherein the input pins are connected to the shorting bar provided in the edge region.

9. The module according to claim 7, wherein the shorting bar has a size greater than each of the plurality of first metal lines.

10. The module according to claim 1, wherein the sweep electrode is provided in a plurality of block units, wherein a plurality of input pins are provided, and the plurality of input pins are connected to a plurality of sweep electrode blocks symmetrically to each other, and wherein the driving unit provides the sweep signal at different times in the plurality of sweep electrode blocks through the plurality of input pins connected to the plurality of sweep electrode blocks.

11. A driving method of a display module including a display panel including an inorganic light emitting device, a sweep electrode connected to input pins, and a pulse width modulation (PWM) pixel circuit, the method comprising:

setting a data voltage to a gate terminal of a driving transistor included in the PWM pixel circuit;

providing a sweep signal to the sweep electrode through the input pins; and based the sweep signal applied to the PWM pixel circuit through the sweep electrode, providing a driving current having a pulse width corresponding to the set data voltage to the inorganic light emitting device by changing a voltage of a gate terminal of the driving transistor according to the sweep signal, wherein the display panel has a stacked structure comprising metal layers including a first metal layer and a second metal layer, wherein the sweep electrode includes a plurality of first metal lines disposed on the first metal layer of the metal layers and a plurality of second metal lines disposed on the second metal layer of the metal layers, the plurality of first metal lines being connected through the plurality of second metal lines, and wherein the input pins are connected to a metal line among the plurality of first metal lines and the plurality of second metal lines.

12. The method according to claim 11, wherein based on the display panel having a first size, a first number of the input pins are provided in the display panel, and based on the display panel having a second size greater than the first size, a second number of the input pins which is more than the first number are provided in the display panel.

13. The method according to claim 11, wherein the providing a sweep signal comprises, providing the same sweep signal through each of the input pins spaced apart at regular intervals.

14. The method according to claim 11, wherein the metal layers further include a third metal layer and a fourth metal layer, wherein the first metal layer includes a gate terminal of the driving transistor, the second metal layer includes source and drain terminals of the driving transistor, the third metal layer includes an electrode for supplying a driving voltage to the PWM pixel circuit, and the fourth metal layer includes an electrode for connecting the PWM pixel circuit and the inorganic light emitting device to each other.

15. The method according to claim 14, wherein the gate terminal of the driving transistor is connected to a metal line among the plurality of first metal lines.

16. The method according to claim 15, wherein the metal line connected to the input pins is provided in an edge region among the plurality of first metal lines and the plurality of second metal lines.

17. The method according to claim 15, wherein the sweep electrode further comprises a shorting bar disposed on at least one of the third metal layer and the fourth metal layer, and connected to at least one metal line of the plurality of first metal lines through at least one via hole.

18. The method according to claim 17, wherein the shorting bar is provided in an edge region of at least one metal layer of the third metal layer and the fourth metal layer, and is connected to a metal line provided in an edge region among the plurality of first metal lines through the via hole, and wherein the input pins are connected to the shorting bar provided in the edge region.

19. The method according to claim 17, wherein the shorting bar has a size greater than each of the plurality of first metal lines.

20. The method according to claim 11, wherein the sweep electrode is provided in a plurality of block units, wherein a plurality of input pins are provided, and the plurality of input pins are connected to each of a plurality of sweep electrode blocks symmetrically to each other, and wherein the providing a sweep signal comprises providing the sweep signal at different time in the plurality of sweep electrode blocks through the plurality of input pins connected to the plurality of sweep electrode blocks.

* * * * *